US008292598B2

(12) United States Patent
Laverdiere et al.

(10) Patent No.: US 8,292,598 B2
(45) Date of Patent: Oct. 23, 2012

(54) SYSTEM AND METHOD FOR A VARIABLE HOME POSITION DISPENSE SYSTEM

(75) Inventors: Marc Laverdiere, Wakefield, MA (US); James Cedrone, Braintree, MA (US); George Gonnella, Pepperell, MA (US); Iraj Gashgaee, Marlborough, MA (US); Paul Magoon, Merrimack, NH (US); Timothy J. King, Sudbury, MA (US)

(73) Assignee: Entegris, Inc., Billerica, MA (US)

( * ) Notice: Subject to any disclaimer, the term of this patent is extended or adjusted under 35 U.S.C. 154(b) by 888 days.

(21) Appl. No.: 11/666,124

(22) PCT Filed: Nov. 21, 2005

(86) PCT No.: PCT/US2005/042127

§ 371 (c)(1),
(2), (4) Date: Sep. 30, 2008

(87) PCT Pub. No.: WO2006/057957

PCT Pub. Date: Jun. 1, 2006

(65) Prior Publication Data

US 2009/0132094 A1 May 21, 2009

Related U.S. Application Data

(60) Provisional application No. 60/630,384, filed on Nov. 23, 2004.

(51) Int. Cl.
*F04B 49/00* (2006.01)

(52) U.S. Cl. ..... 417/274; 417/413.1; 222/63

(58) Field of Classification Search ..... 417/44.1, 417/413.1, 274; 222/63

See application file for complete search history.

(56) References Cited

U.S. PATENT DOCUMENTS

| | | | |
|---|---|---|---|
| 269,626 | A | 12/1882 | Bodel et al. |
| 826,018 | A | 7/1906 | Concoff |
| 1,664,125 | A | 3/1928 | Lowrey |
| 2,153,664 | A | 4/1939 | Freedlander |
| 2,215,505 | A | 9/1940 | Hollander |
| 2,328,468 | A | 8/1943 | Laffly |
| 2,457,384 | A | 12/1948 | Krenz |
| 2,631,538 | A | 3/1953 | Johnson |

(Continued)

FOREIGN PATENT DOCUMENTS

AU B-78872/87 4/1988

(Continued)

OTHER PUBLICATIONS

Notice of Allowance for U.S. Appl. No. 11/602,508, mailed Dec. 14, 2010, 10 pgs.

(Continued)

*Primary Examiner* — Charles Freay
*Assistant Examiner* — Patrick Hamo
(74) *Attorney, Agent, or Firm* — Sprinkle IP Law Group

(57) ABSTRACT

Embodiments of the present, invention provide a system and method for reducing the hold-up volume of a pump. More particularly, embodiments of the present invention provide a system and method for determining a home position to reduce hold-up volume at a dispense pump and/or a feed pump. The home position for the diaphragm can be selected such that the volume of the chamber at the dispense pump and/or feed pump contains sufficient fluid to perform the various steps of a dispense cycle while minimizing the hold-up volume. Additionally, the home position of the diaphragm can be selected to optimize the effective range of positive displacement.

39 Claims, 11 Drawing Sheets

U.S. PATENT DOCUMENTS 2,673,522 A 3/1954 Dickey
2,757,966 A 8/1956 Samiran
3,072,058 A 1/1963 Christopher et al.
3,227,279 A 1/1966 Bockelman
3,250,225 A 5/1966 Taplin
3,327,635 A 6/1967 Sachnik
3,623,661 A 11/1971 Wagner
3,741,298 A 6/1973 Canton
3,895,748 A 7/1975 Klingenberg
3,954,352 A 5/1976 Sakai
4,023,592 A 5/1977 Patzke
4,093,403 A 6/1978 Schrimpf
4,420,811 A 12/1983 Tarnay et al.
4,452,265 A 6/1984 Lonnebring
4,475,818 A 10/1984 Bialkowski
4,483,665 A 11/1984 Hauser
4,541,455 A 9/1985 Hauser
4,597,719 A 7/1986 Tano
4,597,721 A 7/1986 Santefort
4,601,409 A 7/1986 DiRegolo
4,614,438 A 9/1986 Kobayashi
4,671,545 A 6/1987 Miyazaki
4,690,621 A 9/1987 Swain
4,705,461 A 11/1987 Clements
4,739,923 A 4/1988 Tsutsui et al.
4,797,834 A 1/1989 Honganen et al.
4,808,077 A 2/1989 Kan et al.
4,810,168 A 3/1989 Nogami et al.
4,821,997 A 4/1989 Zdeblick
4,824,073 A 4/1989 Zdeblick
4,865,525 A 9/1989 Kern
4,875,623 A 10/1989 Garris
4,913,624 A 4/1990 Seki et al.
4,915,126 A 4/1990 Gyllinder
4,915,160 A 4/1990 Reynolds
4,943,032 A 7/1990 Zdeblick
4,950,134 A 8/1990 Bailey et al.
4,952,386 A 8/1990 Davison
4,966,646 A 10/1990 Zdeblick
4,969,598 A 11/1990 Garris
5,050,062 A 9/1991 Hass
5,061,156 A 10/1991 Kuehne
5,061,574 A 10/1991 Henager, Jr.
5,062,770 A 11/1991 Story
5,134,962 A 8/1992 Amada
5,135,031 A 8/1992 Burgess
5,167,837 A 12/1992 Snodgrass
5,170,361 A 12/1992 Reed
5,192,198 A 3/1993 Gebauer
5,230,445 A 7/1993 Rusnak
5,261,442 A 11/1993 Kingsford
5,262,068 A 11/1993 Bowers
5,312,233 A 5/1994 Tanny et al.
5,316,181 A 5/1994 Burch
5,318,413 A 6/1994 Bertoncini
5,332,311 A 7/1994 Volk, Jr. et al.
5,336,884 A 8/1994 Khoshnevisan et al.
5,344,195 A 9/1994 Parimore, Jr. et al.
5,350,200 A 9/1994 Peterson et al.
5,380,019 A 1/1995 Hillery
5,434,774 A 7/1995 Seberger
5,476,004 A 12/1995 Kingsford
5,490,765 A 2/1996 Bailey
5,511,797 A 4/1996 Nikirk
5,516,429 A 5/1996 Snodgrass
5,527,161 A 6/1996 Bailey
5,546,009 A 8/1996 Raphael
5,575,311 A 11/1996 Kingsford
5,580,103 A 12/1996 Hall
5,599,100 A 2/1997 Jackson et al.
5,599,394 A 2/1997 Yabe
5,645,301 A 7/1997 Kingsford
5,652,391 A 7/1997 Kingsford
5,653,251 A 8/1997 Handler
5,743,293 A 4/1998 Kelly
5,762,795 A 6/1998 Bailey
5,772,899 A 6/1998 Snodgrass
5,784,573 A 7/1998 Szczepanek et al.
5,785,508 A 7/1998 Bolt
5,793,754 A 8/1998 Houldsworth et al.
5,839,828 A 11/1998 Glanville
5,846,056 A 12/1998 Dhindsa et al.
5,848,605 A 12/1998 Bailey
5,947,702 A 9/1999 Biederstadt
5,971,723 A 10/1999 Bolt
5,991,279 A 11/1999 Haugli et al.
6,033,302 A 3/2000 Ahmed et al.
6,045,331 A 4/2000 Gehm et al.
6,105,829 A 8/2000 Snodgrass
6,190,565 B1 2/2001 Bailey
6,210,745 B1 4/2001 Gaughan et al.
6,238,576 B1 5/2001 Yajima
6,250,502 B1 6/2001 Cote
6,251,293 B1 6/2001 Snodgrass
6,298,941 B1 10/2001 Spadafora
6,302,660 B1 10/2001 Kurita
6,318,971 B1 11/2001 Ota
6,319,317 B1 11/2001 Takamori
6,325,032 B1 12/2001 Sekiya et al.
6,325,932 B1 12/2001 Gibson
6,330,517 B1 12/2001 Dobrowski
6,348,098 B1 2/2002 McLoughlin et al.
6,348,124 B1 2/2002 Garbett
6,474,949 B1 11/2002 Arai et al.
6,474,950 B1 11/2002 Waldo
6,478,547 B1 11/2002 Savard
6,497,817 B1 12/2002 Liang
6,506,030 B1 1/2003 Kottke
6,520,519 B2 2/2003 Howard
6,540,265 B2 4/2003 Turk
6,554,579 B2 4/2003 Martin
6,572,255 B2 6/2003 Husher
6,575,264 B2 6/2003 Spadafora
6,592,825 B2 7/2003 Pelc
6,635,183 B2 10/2003 Gibson
6,722,530 B1 4/2004 King et al.
6,742,992 B2 6/2004 Davis
6,742,993 B2 6/2004 Savard
6,766,810 B1 7/2004 Van Cleemput
6,767,877 B2 7/2004 Kuo
6,837,484 B2 1/2005 Kingsford
6,901,791 B1 6/2005 Frenz et al.
6,923,568 B2 8/2005 Wilmer et al.
6,925,072 B1 8/2005 Grohn
6,952,618 B2 10/2005 Davlin et al.
7,013,223 B1 3/2006 Zhang et al.
7,029,238 B1 4/2006 Zagars
7,063,785 B2 6/2006 Hiraku et al.
7,083,202 B2 8/2006 Eberle et al.
7,156,115 B2 1/2007 Everett et al.
7,247,245 B1 7/2007 Proulx et al.
7,249,628 B2 7/2007 Pillion et al.
7,272,452 B2 9/2007 Coogan et al.
7,383,967 B2 6/2008 Gibson
7,454,317 B2 11/2008 Karasawa
7,476,087 B2 1/2009 Zagars et al.
7,494,265 B2 2/2009 Niermeyer et al.
7,547,049 B2 6/2009 Gashgaee
7,660,648 B2 2/2010 Dykstra
7,684,446 B2 3/2010 McLoughlin
7,878,765 B2 2/2011 Gonnella et al.
7,897,196 B2 3/2011 Cedrone et al.
8,025,486 B2 9/2011 Gonnella et al.
8,029,247 B2 10/2011 Cedrone et al.
8,083,498 B2 12/2011 Gonnella et al.
8,087,429 B2 1/2012 Cedrone et al.
8,172,546 B2 5/2012 Cedrone et al.
2001/0000865 A1 5/2001 Gaughen et al.
2002/0044536 A1 4/2002 Izumi et al.
2002/0095240 A1 7/2002 Sickinger
2003/0033052 A1 2/2003 Hillen et al.
2003/0040881 A1 2/2003 Steger et al.
2003/0062382 A1 4/2003 Savard et al.
2003/0148759 A1 8/2003 Leliveid
2003/0222798 A1 12/2003 Floros
2004/0041854 A1 3/2004 Saito et al.
2004/0050771 A1 3/2004 Gibson

| | | | |
|---|---|---|---|
| 2004/0057334 | A1 | 3/2004 | Wilmer et al. |
| 2004/0072450 | A1 | 4/2004 | Collins |
| 2004/0133728 | A1 | 7/2004 | Ellerbrock et al. |
| 2004/0172229 | A1 | 9/2004 | Aragones et al. |
| 2004/0208750 | A1 | 10/2004 | Masuda |
| 2004/0265151 | A1 | 12/2004 | Bertram |
| 2005/0025634 | A1 | 2/2005 | Bernard et al. |
| 2005/0042127 | A1 | 2/2005 | Ohtsuka et al. |
| 2005/0061722 | A1 | 3/2005 | Takao et al. |
| 2005/0113941 | A1 | 5/2005 | Ii et al. |
| 2005/0126985 | A1 | 6/2005 | Campbell |
| 2005/0151802 | A1 | 7/2005 | Neese et al. |
| 2005/0173463 | A1 | 8/2005 | Wesner |
| 2005/0182497 | A1 | 8/2005 | Nakano |
| 2005/0184087 | A1 | 8/2005 | Zagars |
| 2005/0197722 | A1 | 9/2005 | Varone et al. |
| 2005/0232296 | A1 | 10/2005 | Schultze et al. |
| 2005/0238497 | A1 | 10/2005 | Holst |
| 2005/0244276 | A1 | 11/2005 | Pfister et al. |
| 2006/0015294 | A1 | 1/2006 | Yetter, Jr. et al. |
| 2006/0070960 | A1 | 4/2006 | Gibson |
| 2006/0083259 | A1 | 4/2006 | Metcalf et al. |
| 2006/0184264 | A1 | 8/2006 | Willis et al. |
| 2006/0257707 | A1 | 11/2006 | Kaschmitter et al. |
| 2007/0104586 | A1 | 5/2007 | Cedrone |
| 2007/0125796 | A1 | 6/2007 | Cedrone |
| 2007/0125797 | A1 | 6/2007 | Cedrone |
| 2007/0126233 | A1 | 6/2007 | Gashgaee |
| 2007/0127511 | A1 | 6/2007 | Cedrone |
| 2007/0128046 | A1 | 6/2007 | Gonnella |
| 2007/0128047 | A1 | 6/2007 | Gonnella |
| 2007/0128048 | A1 | 6/2007 | Gonnella |
| 2007/0128050 | A1 | 6/2007 | Cedrone |
| 2007/0206436 | A1 | 9/2007 | Niermeyer et al. |
| 2007/0217442 | A1 | 9/2007 | McLoughlin |
| 2007/0251596 | A1 | 11/2007 | Scherzer et al. |
| 2007/0254092 | A1 | 11/2007 | Lin et al. |
| 2008/0036985 | A1 | 2/2008 | Clarke et al. |
| 2008/0089361 | A1 | 4/2008 | Metcalf et al. |
| 2008/0131290 | A1 | 6/2008 | Magoon et al. |
| 2009/0047143 | A1 | 2/2009 | Cedrone |
| 2009/0116334 | A1 | 5/2009 | Niermeyer et al. |
| 2009/0157229 | A1 | 6/2009 | Rulkens et al. |
| 2011/0051576 | A1 | 3/2011 | Ashizawa et al. |
| 2011/0098864 | A1 | 4/2011 | Gonnella et al. |
| 2012/0057990 | A1 | 3/2012 | Cedrone et al. |
| 2012/0070311 | A1 | 3/2012 | Cedrone et al. |
| 2012/0070313 | A1 | 3/2012 | Gonnella et al. |
| 2012/0091165 | A1 | 4/2012 | Cedrone et al. |

FOREIGN PATENT DOCUMENTS

| | | | |
|---|---|---|---|
| CA | 1271140 | | 7/1990 |
| CA | 2246826 | | 3/1999 |
| CN | 1331783 | A | 1/2002 |
| CN | 1434557 | | 8/2003 |
| CN | 1590761 | A | 3/2005 |
| DE | 299 09 100 | U1 | 8/1999 |
| DE | 199 33 202 | A1 | 1/2001 |
| EP | 0 249 655 | A | 12/1987 |
| EP | 0 410 394 | A | 1/1991 |
| EP | 0261972 | B1 | 12/1992 |
| EP | 0577104 | A1 | 1/1994 |
| EP | 0863538 | A2 | 9/1998 |
| EP | 0867649 | A2 | 9/1998 |
| EP | 0 892 204 | A2 | 1/1999 |
| EP | 1133639 | B1 | 6/2004 |
| EP | 1 462 652 | A2 | 9/2004 |
| GB | 661 522 | A | 11/1951 |
| JP | 54-081119 | | 6/1979 |
| JP | 54-165812 | | 11/1979 |
| JP | 55-073563 | | 6/1980 |
| JP | 58203340 | A | 11/1983 |
| JP | 63-255575 | | 10/1988 |
| JP | 02-13184 | | 1/1990 |
| JP | 02-091485 | | 3/1990 |
| JP | 04-167916 | | 6/1992 |
| JP | 51-081413 | | 7/1993 |
| JP | 6-58246 | | 3/1994 |
| JP | 06-103688 | | 4/1994 |
| JP | 08-016563 | | 1/1996 |
| JP | 08-61246 | | 3/1996 |
| JP | 2633005 | | 4/1997 |
| JP | 11 026 430 | A | 1/1999 |
| JP | 11-076394 | | 3/1999 |
| JP | 2963514 | | 8/1999 |
| JP | 11-356081 | | 12/1999 |
| JP | 2001-203196 | | 7/2001 |
| JP | 2004-032916 | | 1/2004 |
| JP | 2004-052748 | | 2/2004 |
| JP | 2004-232616 | | 8/2004 |
| JP | 2004-293443 | | 10/2004 |
| JP | 2006-504035 | | 2/2006 |
| JP | 2009-517601 | | 4/2009 |
| JP | 2009-517618 | | 4/2009 |
| JP | 2009-517778 | | 4/2009 |
| JP | 2009-517888 | | 4/2009 |
| JP | 2009-521636 | | 6/2009 |
| WO | WO 96/35876 | A | 11/1996 |
| WO | WO 99/37435 | | 7/1999 |
| WO | WO 9906514 | A1 | 12/1999 |
| WO | WO 00/31416 | A1 | 6/2000 |
| WO | WO 0140646 | A3 | 6/2001 |
| WO | WO 02/090771 | A2 | 11/2002 |
| WO | WO 03/087675 | | 10/2003 |
| WO | WO 2006057957 | A2 | 6/2006 |
| WO | WO 2007067359 | A2 | 6/2007 |
| WO | WO 2009/059324 | A2 | 5/2009 |

OTHER PUBLICATIONS

Official Action for Chinese Patent Application No. 200680051448.X, mailed Dec. 1, 2010, with English translation, 20 pgs.

Office Action issued in U.S. Appl. No. 11/602,464 mailed Jan. 5, 2011, 12 pgs.

Notice of Allowance for U.S. Appl. No. 11/602,465, mailed Jan. 12, 2011, 19 pgs.

Office Action for Chinese Patent Application No. 200680050801.2, dated Jan. 6, 2011, with English translation, 7 pgs.

Office Action for Japanese Patent Application No. 2008-543344, mailed Feb. 2, 2012, Japanese Patent Office, 6 pgs. (with English translation).

Office Action for Japanese Patent Application No. 2008-544358, mailed Feb. 1, 2012, Japanese Patent Office, 6 pgs. (with English translation).

Notice of Allowance for U.S. Appl. No. 11/602,508, mailed Mar. 4, 2011, 8 pgs.

Office Action for Japanese Patent Application No. 2007-543342, dated Feb. 25, 2011, mailed Mar. 1, 2011, Japanese Patent Office, 12 pgs. with English translation.

Office Action for U.S. Appl. No. 11/602,472, mailed Mar. 21, 2011, 11 pgs.

European Search Report and Written Opinion for European Patent Application No. 06838070.8, dated Mar. 18, 2011, 7 pgs.

European Office Action for European Patent Application No. 06838071.6, dated Mar. 18, 2011, 5 pgs.

Two-page brochure describing a Chempure Pump—A Furon Product.

Fifteen-page publication regarding "Characterization of Low Viscosity Photoresist Coating," Murthy S. Krishna, John W. Lewellen, Gary E. Flores. Advances in Resist Technology and Processing XV (Proceedings of SPIE (The International Society of Optical Engineering), Feb. 23-25, 1998, Santa Clara, California. vol. 3333 (Part Two of Two Parts).

U.S. Patent Office Official Action issued Dec. 13, 2007 in U.S. Appl. No. 11/051,576, Raymond A. Zagars.

Office Action issued Chinese Patent Appl. No. 200680050665.7, dated Mar. 11, 2010 (with English translation) 6 pgs.

Office Action issued in U.S. Appl. No. 11/364,286 mailed Apr. 7, 2010, 22 pgs.

Office Action issued in U.S. Appl. No. 11/292,559 mailed Apr. 14, 2010, 20 pgs.

Office Action issued in U.S. Appl. No. 11/602,508 mailed Apr. 15, 2010, 20 pgs.

Office Action issued in Chinese Patent Application No. CN 200680050801.2, mailed Mar. 26, 2010, 13 pgs. (with English translation).
Office Action issued in U.S. Appl. No. 12/350,688 mailed Apr. 26, 2010, 10 pgs.
International Search Report and Written Opinion issued in PCT/US06/44985, 7 pages.
Notice of Allowance for U.S. Appl. No. 11/602,464, mailed Jul. 11, 2011, 12 pgs.
Patent Cooperation Treaty, International Preliminary Report on Patentability and Written Opinion, Ch. I, issued in PCT/US2006/045176 dated Apr. 9, 2009, Entegris, Inc., 5 pages.
International Search Report and Written Opinion issued in PCT/US07/17017, dated Jul. 3, 2008, 9 pages.
Intellectual Property Office of Singapore, Written Opinion issued in Patent Application No. 200803948-9 dated Jul. 2, 2009, Entegris, Inc., 10 pages.
Office Action for Chinese Patent Application No. 200680043297.3, Chinese Patent Office, dated Jul. 27, 2011 (English translation), 8 pgs.
Office Action issued in U.S. Appl. No. 11/365,395, dated Aug. 19, 2008, McLoughlin, 19 pages.
Office Action for Chinese Patent Application No. 200580039961.2, Chinese Patent Office, dated Aug. 9, 2011, 6 pgs.
Office Action issued in U.S. Appl. No. 11/292,559, dated Aug. 28, 2008, Gonnella, 19 pages.
European Search Report for European Patent Application No. 06844456.1, European Patent Office, dated Jun. 28, 2011, 9 pgs.
Notice of Allowance for U.S. Appl. No. 11/602,472, mailed Sep. 8, 2011, 25 pgs.
Notice of Allowance issued in U.S. Appl. No. 11/364,286 mailed Sep. 21, 2010, 11 pgs.
Chinese Patent Office Official Action, Chinese Patent Application No. 200410079193.0, Mar. 23, 2007.
International Search Report and Written Opinion, PCT/US2006/045127, May 23, 2007.
International Search Report and Written Opinion, PCT/US2006/044908, Jul. 16, 2007.
International Search Report and Written Opinion, PCT/US2006/045175, Jul. 25, 2007.
International Search Report and Written Opinion, PCT/US2006/044907, Aug. 8, 2007.
International Search Report and Written Opinion, PCT/US2006/045177, Aug. 9, 2007.
European Patent Office Official Action, European Patent Application No. 00982386.5, Sep. 4, 2007.
International Search Report and Written Opinion, PCT/US2006/044906, Sep. 5, 2007.
International Search Report and Written Opinion, PCT/US2005/042127, Sep. 26, 2007.
International Search Report and Written Opinion, PCT/US2006/044980, Oct. 4, 2007.
Office Action for Chinese Patent Application No. 200680051205.6, dated Oct. 10, 2011, State Intellectual Property Office of the People's Republic of China, 9 pgs., English translation only.
Notice of Allowance issued in U.S. Appl. No. 11/602,507 mailed Oct. 14, 2010, 8 pgs.
Office Action issued in Chinese Patent Application No. CN 200780046952.5, mailed Sep. 27, 2010, 8 pgs. (English Translation).
Office Action issued in U.S. Appl. No. 11/602,485 mailed Nov. 19, 2010, 9 pgs.
Office Action for Japanese Patent Application No. 2008-543354, mailed Dec. 22, 2011, Japanese Patent Office, 7 pgs. (with English translation).
Office Action for Chinese Patent Application No. 200680050814.X, dated Dec. 23, 2011, State Intellectual Property Office of the People's Republic of China, 6 pgs. (with English translation).
Office Action for Korean Patent Application No. 10-2007-7014324, dated Oct. 31, 2011, Korean Patent Office, 18 pgs. (with English translation).
Notification of Transmittal of International Preliminary Report on Patentability for PCT/US07/17017. Eight pages, dated Jan. 13, 2009.
International Preliminary Report on Patentability, Chap. I, issued in PCT/US2006/044981, mailed Nov. 6, 2008, 7 pgs.
International Preliminary Report on Patentability, Chap. II, issued in PCT/US2006/044981, mailed Feb. 2, 2009, 9 pgs.
Office Action issued in U.S. Appl. No. 11/365,395, mailed Feb. 2, 2009, McLoughlin, 18 pgs.
Office Action issued in U.S. Appl. No. 11/292,559, mailed Dec. 24, 2008, Gonnella, 18 pgs.
Office Action for Chinese Patent Application No. 200680051448.X, dated Feb. 21, 2012, 3 pgs., Chinese Patent Office.
International Search Report and Written Opinion, PCT/US2006/045176, Apr. 21, 2008.
Office Action for U.S. Appl. No. 11/602,485, mailed Apr. 27, 2011, 16 pgs.
Chinese Office Action for Chinese Patent Application No. 200680050665.7, mailed Apr. 26, 2011, Chinese Patent Office, 11 pgs. (English translation).
Office Action for U.S. Appl. No. 11/948,585, mailed May 19, 2011, 59 pgs.
Office Action issued in U.S. Appl. No. 11/602,513, dated May 22, 2008.
International Preliminary Report on Patentability, Chapter I, and Written Opinion issued in PCT/US2006/044985, mailed Jun. 23, 2008, 5 pages.
Office Action issued in U.S. Appl. No. 11/292,559, mailed Apr. 17, 2009, Gonnella, 20 pages.
Office Action issued in U.S. Appl. No. 11/273,091, mailed Feb. 17, 2006, Gibson, 8 pages.
Office Action issued in U.S. Appl. No. 11/273,091, mailed Jul. 3, 2006, Gibson, 8 pages.
Office Action issued in U.S. Appl. No. 11/273,091, mailed Oct. 13, 2006, Gibson, 8 pages.
Office Action issued in U.S. Appl. No. 11/273,091, mailed Feb. 23, 2007, Gibson, 6 pages.
Office Action issued in U.S. Appl. No. 11/273,091, mailed Oct. 15, 2007, Gibson, 8 pages.
Office Action issued in U.S. Appl. No. 11/386,427, mailed Nov. 13, 2007, Niermeyer, 11 pages.
Notice of Allowance for U.S. Appl. No. 11/602,465, mailed Jun. 8, 2011, 15 pgs.
Chinese Office Action for Chinese Patent Application No. 200680045074.0, Chinese Patent Office, dated Jun. 2, 2011, 10 pgs.
Supplementary European Search Report and European Written Opinion in Application No. EP06838071.6, dated Apr. 28, 2010, 5 pgs.
Office Action issued in U.S. Appl. No. 11/602,485 mailed Jun. 9, 2010, 9 pgs.
Office Action issued in U.S. Appl. No. 11/602,507 mailed Jun. 14, 2010, 13 pgs.
Office Action issued in U.S. Appl. No. 11/602,472 mailed Jun. 18, 2010, 13 pgs.
Office Action issued in U.S. Appl. No. 11/602,465 mailed Jun. 18, 2010, 14 pgs.
Office Action issued in U.S. Appl. No. 11/602,464 mailed Jun. 21, 2010, 19 pgs.
Office Action issued in U.S. Appl. No. 11/364,286 mailed Jun. 1, 2009, Gonnella, 14 pgs.
Office Action issued in Chinese Patent Application No. CN 200680045074.0, mailed Jun. 7, 2010, 8 pgs. (with English translation).
Office Action issued in Chinese Patent Application No. CN 200680050814.X (with English translation), mailed Aug. 6, 2010, 10 pgs.
Office Action for Chinese Patent Application No. 200680050801.2 dated Aug. 31, 2011, 5 pgs (English translation only).
European Search Report for European Patent Application No. 07836336.3, European Patent Office, dated Sep. 19, 2011, 5 pgs.
International Search Report, PCT/US99/28002, mailed Mar. 14, 2000, 5 pgs.
Written Opinion issued in PCT/US99/28002, mailed Oct. 25, 2000, 8 pgs.
International Preliminary Examination Report, PCT/US99/28002, mailed Feb. 21, 2001, 9 pgs.

International Search Report and Written Opinion, PCT/US06/44907, mailed Aug. 8, 2007, 9 pgs.
International Preliminary Report on Patentability, Ch. I, PCT/US06/044906, mailed Jun. 5, 2008, 7 pgs.
International Preliminary Report on Patentability, Ch. I, PCT/US2006/044907, mailed Jun. 5, 2008, 7 pgs.
International Preliminary Report on Patentability, Ch. I, PCT/US2006/044980, mailed Jun. 12, 2008, 7 pgs.
International Preliminary Report on Patentability, Ch. I, PCT/US2006/044908, mailed Jun. 12, 2008, 8 pgs.
International Preliminary Report on Patentability, Ch. I, PCT/US2006/045175, mailed Jun. 12, 2008, 6 pgs.
International Preliminary Report on Patentability, Ch. I, PCT/US2006/045127, mailed Jun. 12, 2008, 8 pgs.
International Preliminary Report on Patentability, Ch. I, PCT/US2006/045177, mailed Jun. 12, 2008, 5 pgs.
International Preliminary Report on Patentability, Ch. II, PCT/US07/05377, mailed Oct. 14, 2008, 14 pgs.
European Search Report, European Application No. 06838223.3, dated Aug. 12, 2009, 8 pgs.
Japanese Laid Open Publication No. JP-2009-528631, published Aug. 6, 2009, with International Search Report, Japanese Patent Office, 38 pgs.
Office Action issued in U.S. Appl. No. 09/447,504, mailed Feb. 27, 2001, 4 pgs.
Office Action issued in U.S. Appl. No. 09/447,504, mailed Nov. 18, 2003, 4 pgs.
Office Action issued in U.S. Appl. No. 09/447,504, mailed Jul. 13, 2004, 5 pgs.
Japanese Laid Open Publication No. JP-2009-529847, published Aug. 20, 2009, with International Search Report, Japanese Patent Office, 21 pgs.
Intellectual Property Office of Singapore, Written Opinion issued in Patent Application No. 200703671-8, dated Jul. 20, 2009, 4 pgs.
Chinese Patent Office Official Action, Chinese Patent Application No. 200580039961.2, dated Aug. 21, 2009 with English translation, 33 pgs.
English translation of Office Action for Chinese Patent Application No. 200680050665.7 dated Nov. 23, 2011, 7 pgs.
Office Action for U.S. Appl. No. 12/218,325, mailed Dec. 13, 2011, 70 pgs.
English translation of Office Action for Chinese Patent Application No. 200680050801.2 dated Dec. 1, 2011, 3 pgs.
Notice of Allowance for U.S. Appl. No. 11/602,508, mailed Jul. 20, 2011, 11 pgs.
International Search Report and Written Opinion issued in PCT/US07/05377 mailed Jun. 4, 2008.
Chinese Patent Office Official Action, Chinese Patent Application No. 2005101088364 dated May 23, 2008.
International Search Report and Written Opinion issued in PCT/US06/44981, dated Aug. 8, 2008, 10 pages.
Intellectual Property Office of Singapore, Written Opinion issued in Patent Application No. 200806425-5 dated Oct. 14, 2009, 8 pgs.
Office Action issued in U.S. Appl. No. 11/602,507 mailed Oct. 28, 2009, 12 pgs.
Office Action issued in U.S. Appl. No. 11/292,559 mailed Nov. 3, 2009, 17 pgs.
Office Action issued in U.S. Appl. No. 11/364,286 mailed Nov. 9, 2009, 19 pgs.
Office Action for Japanese Patent Application No. 2008-543355, mailed Jan. 5, 2012, Japanese Patent Office, 5 pgs. (with English translation).
Office Action for Japanese Patent Application No. 2008-541406, mailed Jan. 10, 2012, Japanese Patent Office, 11 pgs. (with English translation).
Office Action for U.S. Appl. No. 11/948,585, mailed Jan. 19, 2012, 19 pgs.
Intellectual Property Office of Singapore, Written Opinion issued in Patent Application No. 200803948-9 dated Jan. 19, 2010, 10 pgs.
Office Action issued in U.S. Appl. No. 11/364,286 dated Nov. 14, 2008, Gonella, 11 pages.
Office Action issued in U.S. Appl. No. 11/602,513, dated Nov. 14, 2008, Gashgaee, 7 pages.
Final Rejection for Japanese Patent Application No. 2007-543342, Japanese Patent Office, mailed Feb. 21, 2012, 8 pgs. (with English translation).
English translation of Office Action for Chinese Patent Application No. 200780046952.5, Chinese Patent Office, mailed Feb. 28, 2012, 5 pgs.
Office Action for U.S. Appl. No. 11/948,585, mailed Mar. 14, 2012, 14 pgs.
Notice of Allowance for U.S. Appl. No. 11/602,472, mailed Mar. 29, 2012, 11 pgs.
Office Action for Japanese Patent Application No. 2008-541407, Japanese Patent Office, mailed Mar. 27, 2012, 7 pgs. (with English translation).
Office Action for Japanese Patent Application No. 2008-543343, Japanese Patent Office, mailed Mar. 27, 2012, 6 pgs. (with English translation).
Office Action for Japanese Patent Application No. 2009-539238, mailed Apr. 24, 2012, 6 pgs. (with English translation).
Office Action for Taiwan Patent Application No. 094140888, mailed Mar. 20, 2012, 5 pgs.
Office Action for Korea Patent Application No. 10-2007-7014324, mailed May 18, 2012, 6 pgs.
Office Action for Chinese Patent Application No. 200580039961.2, dated Apr. 12, 2012 (with English translation) 6 pgs.
Office Action for European Patent Application No. 07836336.3, mailed May 15, 2012, 5 pgs.
Office Action for Chinese Patent Application No. 200680051205.6, mailed May 24, 2012, 7 pgs. (with English translation).
Office Action for Japanese Patent Application No. 2008-543342, mailed Jun. 5, 2012, 8 pgs. (with English translation).
Office Action for Chinese Patent Application No. 200680050665.7, mailed Jul. 4, 2012, 12 pgs. (with English translation).

SYSTEM AND METHOD FOR A VARIABLE HOME POSITION DISPENSE SYSTEM

RELATED APPLICATIONS

The present application claims under 35 U.S.C. §119(e) the benefit of and priority to U.S. Provisional Patent Application 60/630,384, entitled "System and Method for a Variable Home Position Dispense System" by Laverdiere et al., filed Nov. 23, 2004, which is hereby fully incorporated by reference herein.

TECHNICAL FIELD

Embodiments of the present invention generally relate to pumping systems and more particularly to dispense pumps. Even more particularly, embodiments of the present invention provide systems and method for reducing the hold-up volume for a dispense pump.

BACKGROUND

Dispense systems for semiconductor manufacturing applications are designed to dispense a precise amount of fluid on a wafer. In one-phase systems, fluid is dispensed to a wafer from a dispense pump through a filter. In two-phase systems, fluid is filtered in a filtering phase before entering a dispense pump. The fluid is then dispensed directly to the wafer in a dispense phase.

In either case, the dispense pump typically has a chamber storing a particular volume of fluid and a movable diaphragm to push fluid from the chamber. Prior to dispense, the diaphragm is typically positioned so that the maximum volume of the chamber is utilized regardless of the volume of fluid required for a dispense operation. Thus, for example, in a 10 mL dispense pump, the chamber will store 10.5 mL or 11 mL of fluid even if each dispense only requires 3 mL of fluid (a 10 mL dispense pump will have a slightly larger chamber to ensure there is enough fluid to complete the maximum anticipated dispense of 10 mL). For each dispense cycle, the chamber will be filled to its maximum capacity (e.g., 10.5 mL or 11 mL, depending on the pump). This means that for a 3 mL dispense there is at least 7.5 mL "hold-up" volume (e.g., in a pump having a 10.5 mL chamber) of fluid that is not used for a dispense.

In two-phase dispense systems the hold-up volume increases because the two-phase systems utilize a feed pump that has a hold-up volume. If the feed pump also has a 10.5 mL capacity, but only needs to provide 3 mL of fluid to the dispense pump for each dispense operation, the feed pump will also have a 7.5 mL unused hold-up volume, leading, in this example, to a 15 mL of unused hold-up volume for the dispense system as a whole.

The hold-up volume presents several issues. One issue is that extra chemical waste is generated. When the dispense system is initially primed, excess fluid than what is used for the dispense operations is required to fill the extra volume at the dispense pump and/or feed pump. The hold-up volume also generates waste when flushing out the dispense system. The problem of chemical waste is exacerbated as hold-up volume increases.

A second issue with a hold-up volume is that fluid stagnation takes place. Chemicals have the opportunity to gel, crystallize, degas, separate etc. Again, these problems are made worse with a larger hold-up volume especially in low dispense volume applications. Stagnation of fluid can have deleterious effects on a dispense operation.

Systems with large hold-up volumes present further shortcomings with respect to testing new chemicals in a semiconductor manufacturing process. Because many semiconductor manufacturing process chemicals are expensive (e.g., thousands of dollars a liter), new chemicals are tested on wafers in small batches. Because semiconductor manufacturers do not wish to waste the hold-up volume of fluid and associated cost by running test dispenses using a multi-stage pump, they have resorted to dispensing small amounts of test chemicals using a syringe; for example. This is an inaccurate, time consuming and potentially dangerous process that is not representative of the actual dispense process.

SUMMARY OF THE INVENTION

Embodiments of the present invention provide a system and method of fluid pumping that eliminates, or at least substantially reduces, the shortcomings of prior art pumping systems and methods. One embodiment of the present invention can include a pumping system comprising a dispense pump having a dispense diaphragm movable in a dispense chamber, and a pump controller coupled to the dispense pump. The pump controller, according to one embodiment, is operable to control the dispense pump to move the dispense diaphragm in the dispense chamber to reach a dispense pump home position to partially fill the dispense pump. The available volume corresponding to the dispense pump home position is less than the maximum available volume of the dispense pump and is the greatest available volume for the dispense pump in a dispense cycle. The dispense pump home position is selected based on one or more parameters for a dispense operation.

Another embodiment of the present invention includes a multi-stage pumping system comprising a feed pump that has a feed diaphragm movable within a feed chamber, a dispense pump downstream of the feed pump that has a dispense diaphragm movable within a dispense chamber and a pump controller coupled to the feed pump and the dispense pump to control the feed pump and the dispense pump.

The dispense pump can have a maximum available volume that is the maximum volume of fluid that the dispense pump can hold in the dispense chamber. The controller can control the dispense pump to move the dispense diaphragm in the dispense chamber to reach a dispense pump home position to partially fill the dispense pump. The available volume for holding fluid at the dispense pump corresponding to the dispense pump home position is less than the maximum available volume of the dispense pump and is the greatest available volume for the dispense pump in a dispense cycle. By reducing the amount of fluid held by the dispense pump to the amount required by the dispense pump in a particular dispense cycle (or some other reduced amount from the maximum available volume), the hold-up volume of fluid is reduced.

Another embodiment of the present invention includes a method for reducing the hold-up volume of a pump that comprises asserting pressure on the process fluid, partially filling a dispense pump to a dispense pump home position for a dispense cycle, and dispensing a dispense volume of the process fluid from the dispense pump to a wafer. The dispense pump has an available volume corresponding to the dispense pump home position that is less than the maximum available volume of the dispense pump and is the greatest available volume at the dispense pump for the dispense cycle. The available volume corresponding to the dispense pump home position of the dispense pump is at least the dispense volume.

Another embodiment of the present invention includes a computer program product for controlling a pump. The computer program product comprises software instructions stored on a computer readable medium that are executable by a processor. The set of computer instructions can comprise instructions executable to direct a dispense pump to move a dispense diaphragm to reach a dispense pump home position to partially fill the dispense pump, and direct the dispense pump to dispense a dispense volume of the process fluid from the dispense pump. The available volume of the dispense pump corresponding to the dispense pump home position is less than the maximum available volume of the dispense pump and is the greatest available volume for the dispense pump in a dispense cycle.

Embodiments of the present invention provide an advantage over prior art pump systems and methods by reducing the hold-up volume of the pump (single stage or multi-stage), thereby reducing stagnation of the process fluid.

Embodiments of the present invention provide another advantage by reducing the waste of unused process fluids in small volume and test dispenses.

Embodiments of the present invention provide yet another advantage by providing for more efficient flushing of stagnant fluid.

Embodiments of the present invention provide yet another advantage by optimizing the effective range of a pump diaphragm.

BRIEF DESCRIPTION OF THE FIGURES

A more complete understanding of the present invention and the advantages thereof may be acquired by referring to the following description, taken in conjunction with the accompanying drawings in which like reference numbers indicate like features and wherein.

DETAILED DESCRIPTION

Preferred embodiments of the invention are illustrated in the FIGURES, like numerals being used to refer to like and corresponding parts of the various drawings.

Embodiments of the present invention provide a system and method for reducing the hold-up volume of a pump. More particularly, embodiments of the present invention provide a system and method for determining a home position to reduce hold-up volume at a dispense pump and/or a feed pump. The home position for the diaphragm can be selected such that the volume of the chamber at the dispense pump and/or feed pump contains sufficient fluid to perform the various steps of a dispense cycle while minimizing the hold-up volume. Additionally, the home position of the diaphragm can be selected to optimize the effective range of positive displacement.

Figure 1:
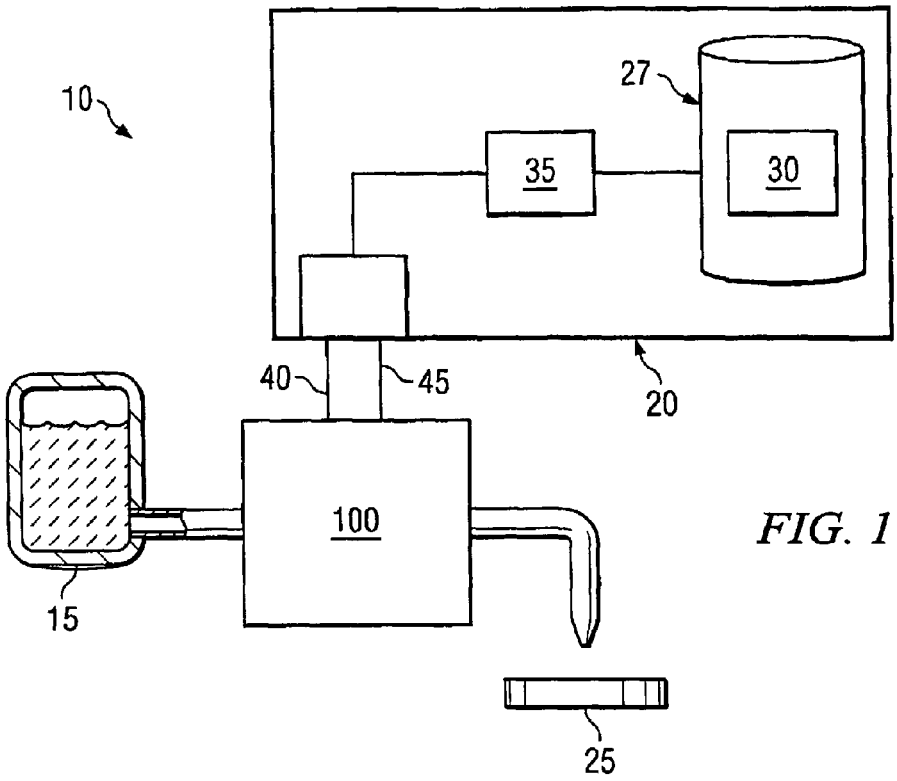
FIG. 1 is a diagrammatic representation of a pumping system.

FIG. 1 is a diagrammatic representation of a pumping system 10. The pumping system 10 can include a fluid source 15, a pump controller 20 and a multiple stage ("multi-stage") pump 100, which work together to dispense fluid onto a wafer 25. The operation of multi-stage pump 100 can be controlled by pump controller 20, which can be onboard multi-stage pump 100 or connected to multi-stage pump 100 via one or more communications links for communicating control signals, data or other information. Pump controller 20 can include a computer readable medium 27 (e.g., RAM, ROM, Flash memory, optical disk, magnetic drive or other computer readable medium) containing a set of control instructions 30 for controlling the operation of multi-stage pump 100. A processor 35 (e.g., CPU, ASIC, RISC or other processor) can execute the instructions. In the embodiment of FIG. 1, controller 20 communicates with multi-stage pump 100 via communications links 40 and 45. Communications links 40 and 45 can be networks (e.g., Ethernet, wireless network, global area network, DeviceNet network or other network known or developed in the art), a bus (e.g., SCSI bus) or other communications link. Pump controller 20 can include appropriate interfaces (e.g., network interfaces, I/O interfaces, analog to digital converters and other components) to allow pump controller 20 to communicate with multi-stage pump 100. Pump controller 20 includes a variety of computer components known in the art including processors, memories, interfaces, display devices, peripherals or other computer components. Pump controller 20 controls various valves and motors in multi-stage pump to cause multi-stage pump to accurately dispense fluids, including low viscosity fluids (i.e., less than 5 centipoises) or other fluids. It should be noted that while FIG. 1 uses the example of a multi-stage pump, pumping system 10 can also use a single stage pump.

Figure 2:
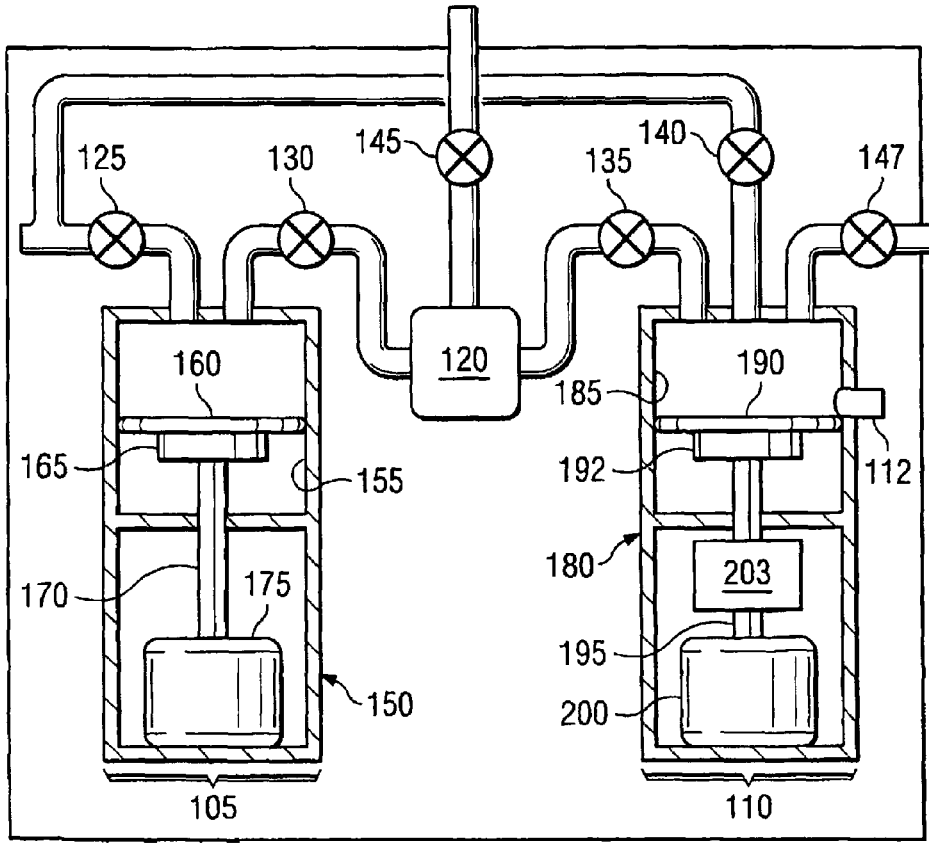
FIG. 2 is a diagrammatic representation of a multi-stage pump.

FIG. 2 is a diagrammatic representation of a multi-stage pump 100. Multi-stage pump 100 includes a feed stage portion 105 and a separate dispense stage portion 110. Located between feed stage portion 105 and dispense stage portion 110, from a fluid flow perspective, is filter 120 to filter impurities from the process fluid. A number of valves can control fluid flow through multi-stage pump 100 including, for example, inlet valve 125, isolation valve 130, barrier valve 135, purge valve 140, vent valve 145 and outlet valve 147. Dispense stage portion 110 can further include a pressure sensor 112 that determines the pressure of fluid at dispense stage 110.

Feed stage 105 and dispense stage 110 can include rolling diaphragm pumps to pump fluid in multi-stage pump 100. Feed-stage pump 150 ("feed pump 150"), for example, includes a feed chamber 155 to collect fluid, a feed stage diaphragm 160 to move within feed chamber 155 and displace fluid, a piston 165 to move feed stage diaphragm 160, a lead screw 170 and a feed motor 175. Lead screw 170 couples to feed motor 175 through a nut, gear or other mechanism for imparting energy from the motor to lead screw 170. According to one embodiment, feed motor 175 rotates a nut that, in turn, rotates lead screw 170, causing piston 165 to actuate. Dispense-stage pump 180 ("dispense pump 180") can similarly include a dispense chamber 185, a dispense stage diaphragm 190, a piston 192, a lead screw 195, and a dispense motor 200. According to other embodiments, feed stage 105 and dispense stage 110 can each include a variety of other pumps including pneumatically actuated pumps, hydraulic pumps or other pumps. One example of a multi-stage pump using a pneumatically actuated pump for the feed stage and a stepper motor driven dispense pump is described in U.S. patent application Ser. No. 11/051,576, which is hereby fully incorporated by reference herein.

Feed motor 175 and dispense motor 200 can be any suitable motor. According to one embodiment, dispense motor 200 is a Permanent-Magnet Synchronous Motor ("PMSM") with a position sensor 203. The PMSM can be controlled by a digital signal processor ("DSP") utilizing Field-Oriented Control ("FOC") at motor 200, a controller onboard multi-stage pump 100 or a separate pump controller (e.g. as shown in FIG. 1). Position sensor 203 can be an encoder (e.g., a fine line rotary position encoder) for real time feedback of motor 200's position. The use of position sensor 203 gives accurate and repeatable control of the position of piston 192, which leads to accurate and repeatable control over fluid movements in dispense chamber 185. For, example, using a 2000 line encoder, it is possible to accurately measure to and control at 0.045 degrees of rotation. In addition, a PMSM can run at low velocities with little or no vibration. Feed motor 175 can also be a PMSM or a stepper motor.

The valves of multi-stage pump 100 are opened or closed to allow or restrict fluid flow to various portions of multi-stage pump 100. According to one embodiment, these valves can be pneumatically actuated (i.e., gas driven) diaphragm valves that open or close depending on whether pressure or a vacuum is asserted. However, in other embodiments of the present invention, any suitable valve can be used.

In operation, the dispense cycle multi-stage pump 100 can include a ready segment, dispense segment, fill segment, pre-filtration segment, filtration segment, vent segment, purge segment and static purge segment. Additional segments can also be included to account for delays in valve openings and closings. In other embodiments the dispense cycle (i.e., the series of segments between when multi-stage pump 100 is ready to dispense to a wafer to when multi-stage pump 100 is again ready to dispense to wafer after a previous dispense) may require more or fewer segments and various segments can be performed in different orders. During the feed segment, inlet valve 125 is opened and feed stage pump 150 moves (e.g., pulls) feed stage diaphragm 160 to draw fluid into feed chamber 155. Once a sufficient amount of fluid has filled feed chamber 155, inlet valve 125 is closed. During the filtration segment, feed-stage pump 150 moves feed stage diaphragm 160 to displace fluid from feed chamber 155. Isolation valve 130 and barrier valve 135 are opened to allow fluid to flow through filter 120 to dispense chamber 185. Isolation valve 130, according to one embodiment, can be opened first (e.g., in the "pre-filtration segment") to allow pressure to build in filter 120 and then barrier valve 135 opened to allow fluid flow into dispense chamber 185. Furthermore, pump 150 can assert pressure on the fluid before pump 180 retracts, thereby also causing the pressure to build.

At the beginning of the vent segment, isolation valve 130 is opened, barrier valve 135 closed and vent valve 145 opened. In another embodiment, barrier valve 135 can remain open during the vent segment and close at the end of the vent segment. Feed-stage pump 150 applies pressure to the fluid to remove air bubbles from filter 120 through open vent valve 145 by forcing fluid out the vent. Feed-stage pump 150 can be controlled to cause venting to occur at a predefined rate, allowing for longer vent times and lower vent rates, thereby allowing for accurate control of the amount of vent waste.

At the beginning of the purge segment, isolation valve 130 is closed, barrier valve 135, if it is open in the vent segment, is closed, vent valve 145 closed, and purge valve 140 opened. Dispense pump 180 applies pressure to the fluid in dispense chamber 185. The fluid can be routed out of multi-stage pump 100 or returned to the fluid supply or feed-pump 150. During the static purge segment, dispense pump 180 is stopped, but purge valve 140 remains open to relieve pressure built up during the purge segment. Any excess fluid removed during the purge or static purge segments can be routed out of multi-stage pump 100 (e.g., returned to the fluid source or discarded) or recycled to feed-stage pump 150. During the ready segment, all the valves can be closed.

During the dispense segment, outlet valve 147 opens and dispense pump 180 applies pressure to the fluid in dispense chamber 185. Because outlet valve 147 may react to controls more slowly than dispense pump 180, outlet valve 147 can be opened first and some predetermined period of time later dispense motor 200 started. This prevents dispense pump 180 from pushing fluid through a partially opened outlet valve 147. In other embodiments, the pump can be started before outlet valve 147 is opened or outlet valve 147 can be opened and dispense begun by dispense pump 180 simultaneously.

An additional suckback segment can be performed in which excess fluid in the dispense nozzle is removed by pulling the fluid back. During the suckback segment, outlet valve 147 can close and a secondary motor or vacuum can be used to suck excess fluid out of the outlet nozzle. Alternatively, outlet valve 147 can remain open and dispense motor 200 can be reversed to such fluid back into the dispense chamber. The suckback segment helps prevent dripping of excess fluid onto the wafer.

FIGS. 3A-3G provide diagrammatic representations of multi-stage pump 100 during various segments of operation in which multi-stage pump 100 does not compensate for hold up volume. For the sake of example, it is assumed that dispense pump 180 and feed pump 150 each have a 20 mL maximum available capacity, the dispense process dispenses 4 mL of fluid, the vent segment vents 0.5 mL of fluid and the purge segment (including static purge) purges 1 mL of fluid and the suckback volume is 1 mL. During the ready segment (FIG. 3A), isolation valve 130 and barrier valve 135 are open while inlet valve 125, vent valve 145, purge valve 140 and outlet valve 147 are closed. Dispense pump 180 will be near its maximum volume (e.g., 19 ml) (i.e., the maximum volume minus the 1 mL purged from the previous cycle). During the dispense segment (FIG. 3B), isolation valve 130, barrier valve 135, purge valve 140, vent valve 145 and inlet valve 125 are closed and outlet valve 147 is opened. Dispense pump 180 dispenses a predefined amount of fluid (e.g., 4 mL). In this example, at the end of the dispense segment, dispense pump 180 will have a volume of 15 mL.

During the suckback segment (FIG. 3C), some of the fluid (e.g., 1 mL) dispensed during the dispense segment can be sucked back into dispense pump 180 to clear the dispense nozzle. This can be done, for example, by reversing the dispense motor. In other embodiments, the additional 1 mL of fluid can be removed from the dispense nozzle by a vacuum or another pump. Using the example in which the 1 mL is sucked back into dispense pump 180, after the suckback segment, dispense pump 180 will have a volume of 16 mL.

In the feed segment (FIG. 3D), outlet valve 147 is closed and inlet valve 125 is opened. Feed pump 150, in prior system, fills with fluid to its maximum capacity (e.g., 20 mL). During the filtration segment, inlet valve 125 is closed and isolation valve 130 and barrier valve 135 opened. Feed pump 150 pushes fluid out of feed pump 150 through filter 120, causing fluid to enter dispense pump 180. In prior systems, dispense pump 180 is filled to its maximum capacity (e.g., 20 mL) during this segment. During the dispense segment and continuing with the previous example, feed pump 150 will displace 4 mL of fluid to cause dispense pump 180 to fill from 16 mL (the volume at the end of the suckback segment) to 20 mL (dispense pump 180's maximum volume). This will leave feed pump 150 with 16 mL of volume.

During the vent segment (FIG. 3F), barrier valve 135 can be closed or open and vent valve 145 is open. Feed pump 150 displaces a predefined amount of fluid (e.g., 0.5 mL) to force excess fluid or gas bubbles accumulated at filter 120 out vent valve 145. Thus, at the end of the vent segment, in this example, feed pump 150 is at 15.5 mL.

Dispense pump 180, during the purge segment (FIG. 3G) can purge a small amount of fluid (e.g., 1 mL) through open purge valve 140. The fluid can be sent to waste or re-circulated. At the end of the purge segment, multi-stage pump 100 is back to the ready segment, with the dispense pump at 19 mL.

In the example of FIGS. 3A-3G, dispense pump 180 only uses 5 mL of fluid, 4 mL for the dispense segment (1 mL of which is recovered in suckback) and 1 mL for the purge segment. Similarly, feed pump 150 only uses 4 to recharge dispense pump 180 in the filtration segment (4 mL to recharge for the dispense segment minus 1 mL recovered during suckback plus 1 mL to recharge for the purge segment) and 0.5 mL in the vent segment. Because both feed pump 150 and dispense pump 180 are filled to their maximum available volume (e.g., 20 mL each) there is a relatively large hold-up volume. Feed pump 150, for example, has a hold-up volume of 15.5 mL and dispense pump 180 has a hold-up volume of 15 mL, for a combined hold-up volume of 30.5 mL.

The hold-up volume is slightly reduced if fluid is not sucked back into the dispense pump during the suckback segment. In this case, the dispense pump 180 still uses 5 mL of fluid, 4 mL during the dispense segment and 1 mL during the purge segment. However, feed pump 150, using the example above, must recharge the 1 mL of fluid that is not recovered during suckback. Consequently feed pump 150 will have to recharge dispense pump 180 with 5 mL of fluid during the filtration segment. In this case feed pump 150 will have a hold-up volume of 14.5 mL and dispense pump 180 will have a hold up volume of 15 mL.

Embodiments of the present invention reduce wasted fluid by reducing the hold-up volume. According to embodiments of the present invention, the home position of the feed and dispense pumps can be defined such that the fluid capacity of the dispense pump is sufficient to handle a given "recipe" (i.e., a set of factors affecting the dispense operation including, for example, a dispense rate, dispense time, purge volume, vent volume or other factors that affect the dispense operation), a given maximum recipe or a given set of recipes. The home position of a pump is then defined as the position of the pump that has the greatest available volume for a given cycle. For example, the home position can be the diaphragm position that gives a greatest allowable volume during a dispense cycle. The available volume corresponding to the home position of the pump will typically be less than the maximum available volume for the pump.

Using the example above, given the recipe in which the dispense segment uses 4 mL of fluid, the purge segment 1 mL, the vent segment 0.5 mL and the suckback segment recovers 1 mL of fluid, the maximum volume required by the dispense pump is:

$$V_{DMax}=V_D+V_P+e_1 \quad \text{[EQN 1]}$$

$V_{DMax}$=maximum volume required by dispense pump
$V_{DMax}$=volume dispensed during dispense segment
$V_P$=volume purged during purge segment
$e_1$=an error volume applied to dispense pump and the maximum volume required by feed pump 150 is:

$$V_{Fmax}=V_D+V_P+V_V-V_{suckback}+e_2 \quad \text{[EQN 2]}$$

$V_{Fmax}$=maximum volume required by dispense pump
$V_D$=volume dispensed during dispense segment
$V_P$=volume purged during purge segment
$V_V$=volume vented during vent segment
$V_{suckback}$=volume recovered during suckback
$e_2$=error volume applied to feed pump Assuming no error volumes are applied and using the example above, $V_{DMax}$=4+1=5 mL and $V_F$ max=4+1+0.5−1=4.5 mL. In cases in which dispense pump 180 does not recover fluid during suckback, the $V_{suckback}$ term can be set to 0 or dropped. $e_1$ and $e_2$ can be zero, a predefined volume (e.g., 1 mL), calculated volumes or other error factor. $e_1$ and $e_2$ can have the same value or different values (assumed to be zero in the previous example).

Figure 3A:
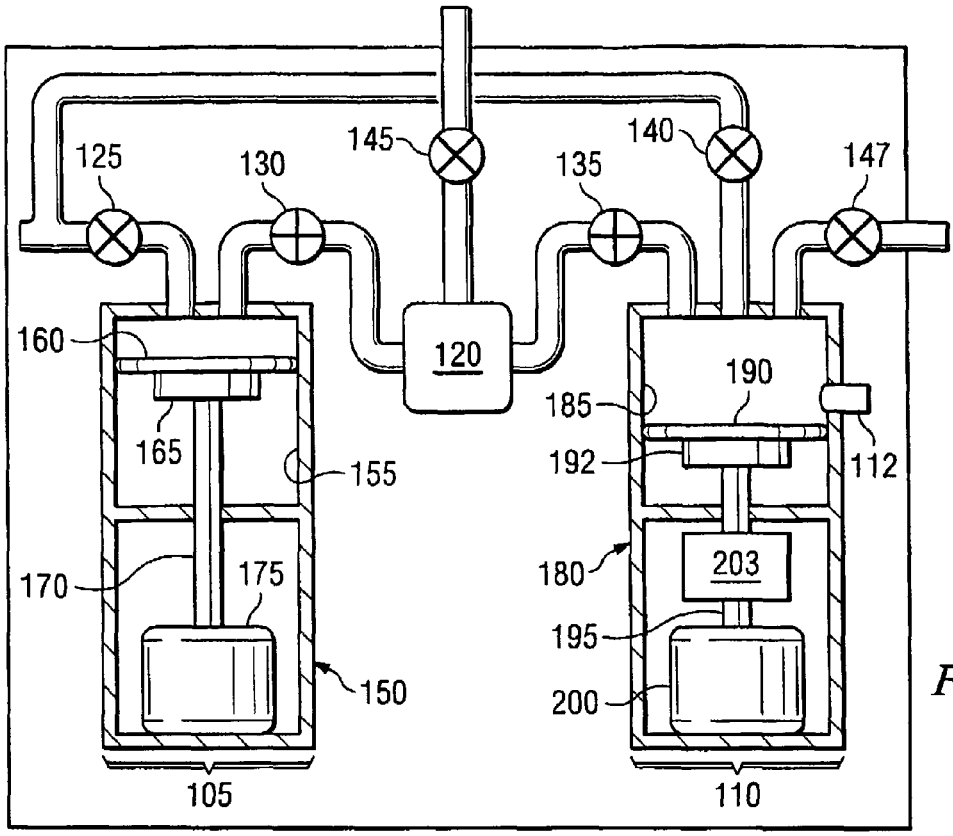
FIGS. 3A-3G provide diagrammatic representations of one embodiment of a multi-stage pump during various stages of operation
Figure 3B:
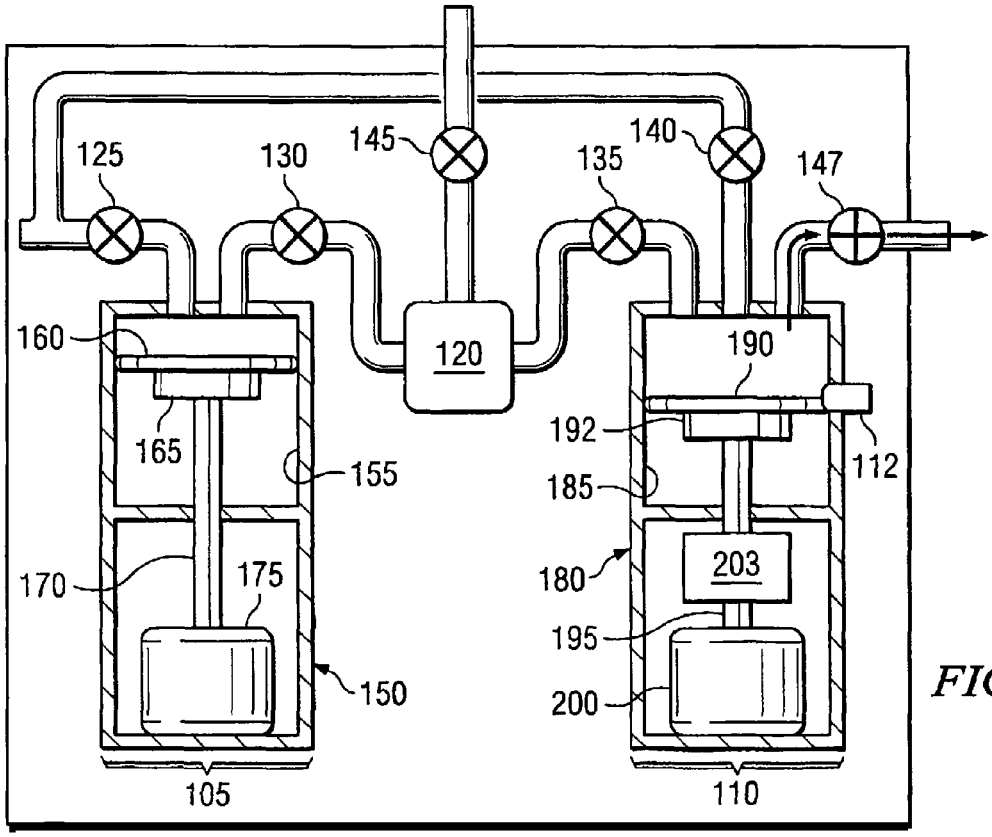
Figure 3C:
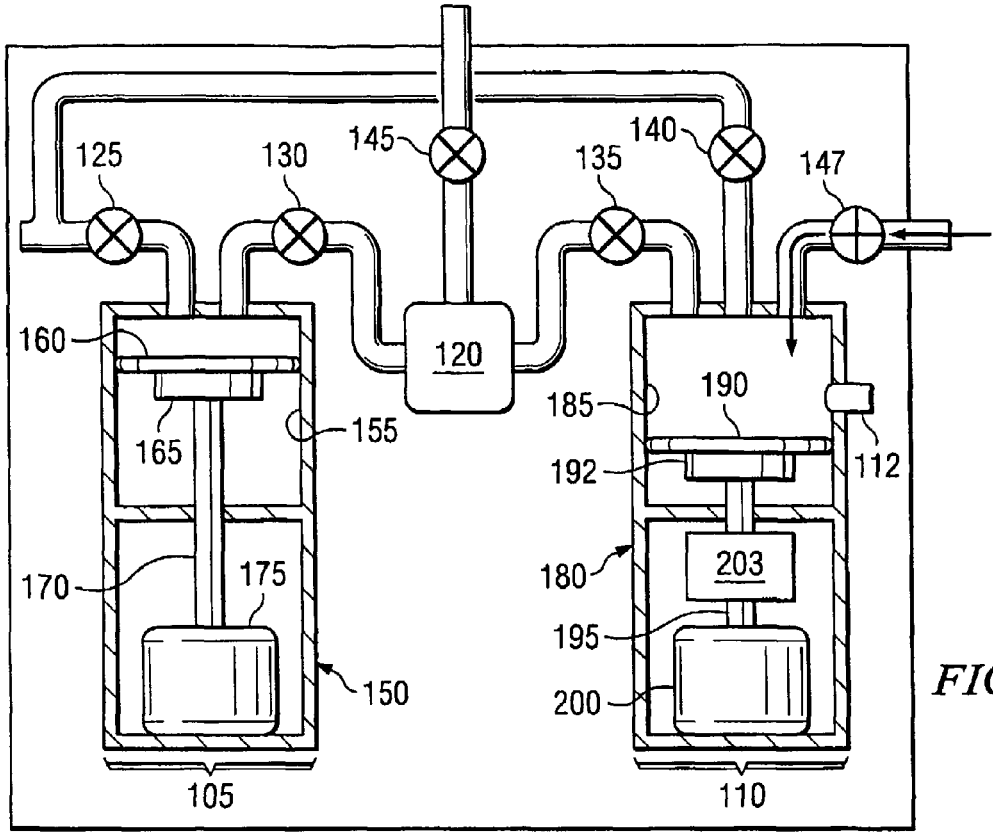
Figure 3D:
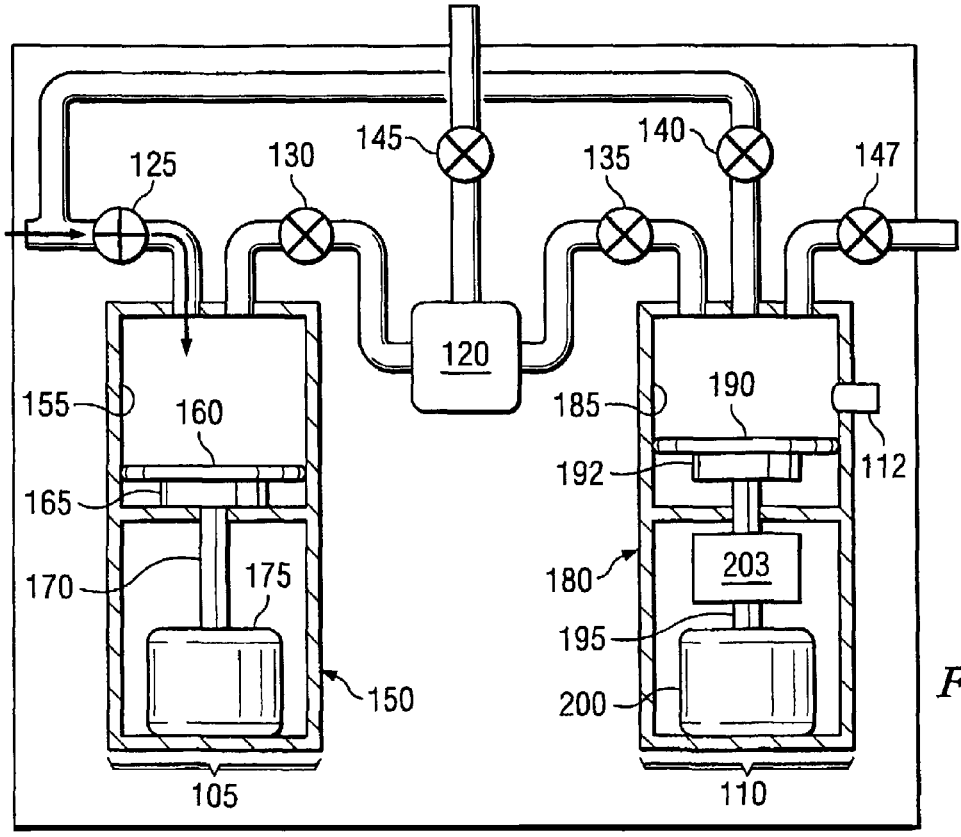
Figure 3E:
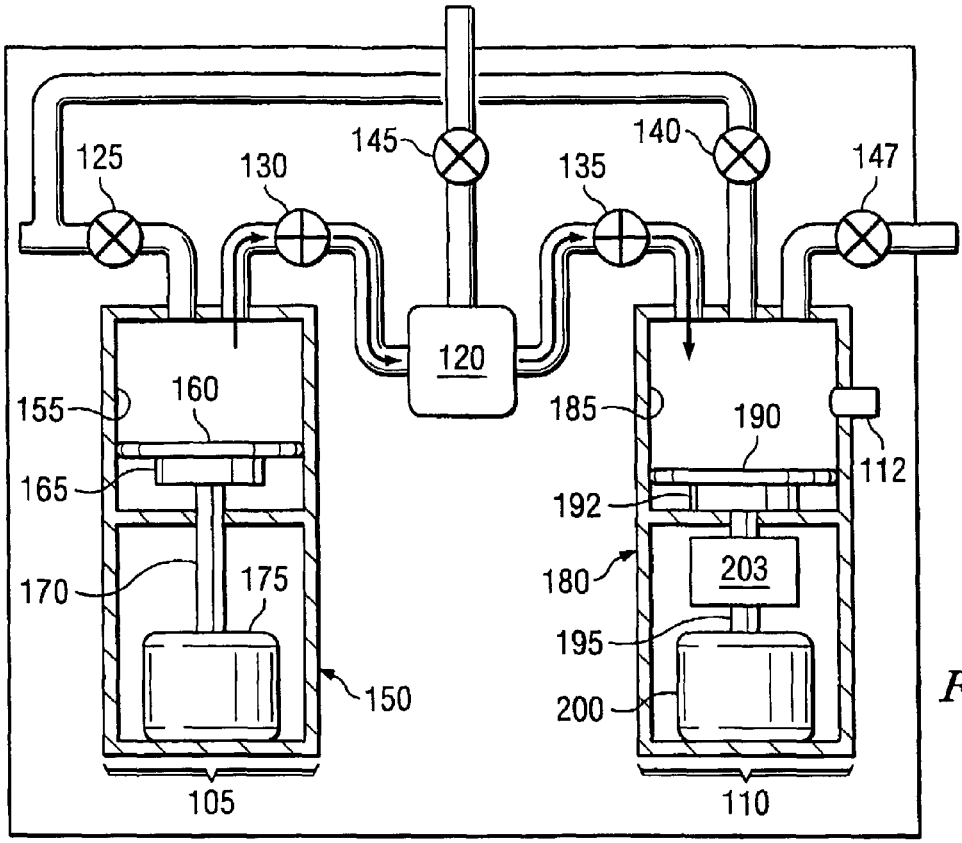
Figure 3F:
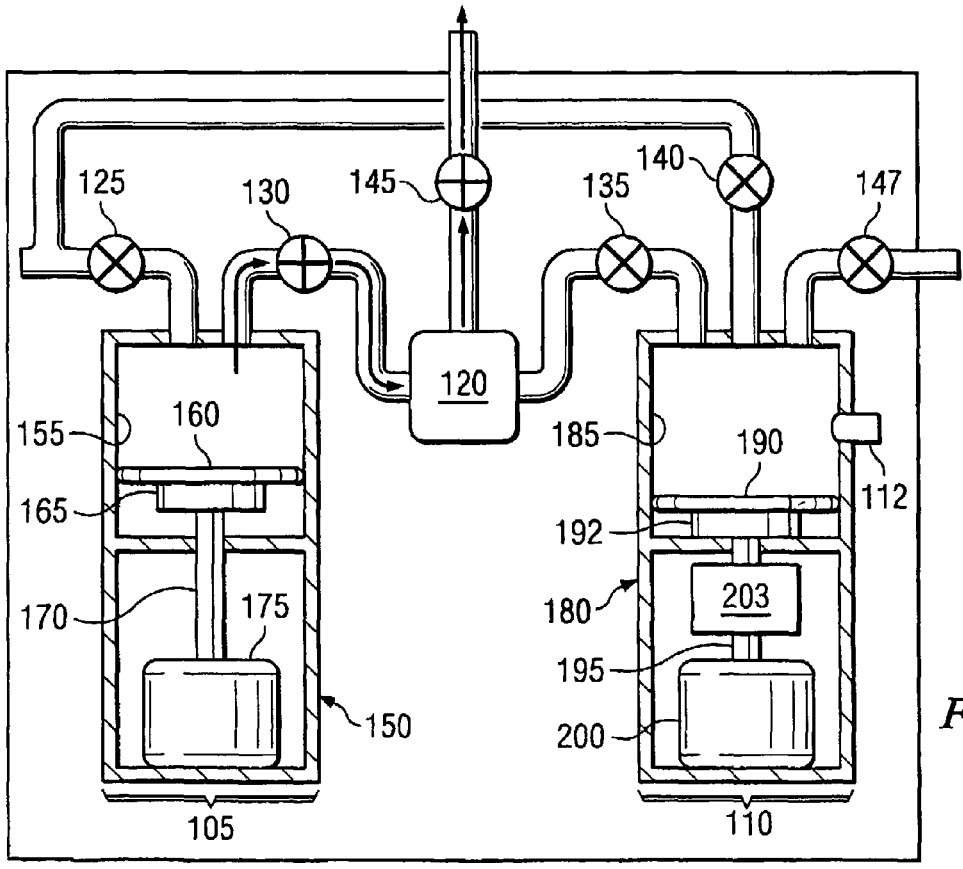
Figure 3G:
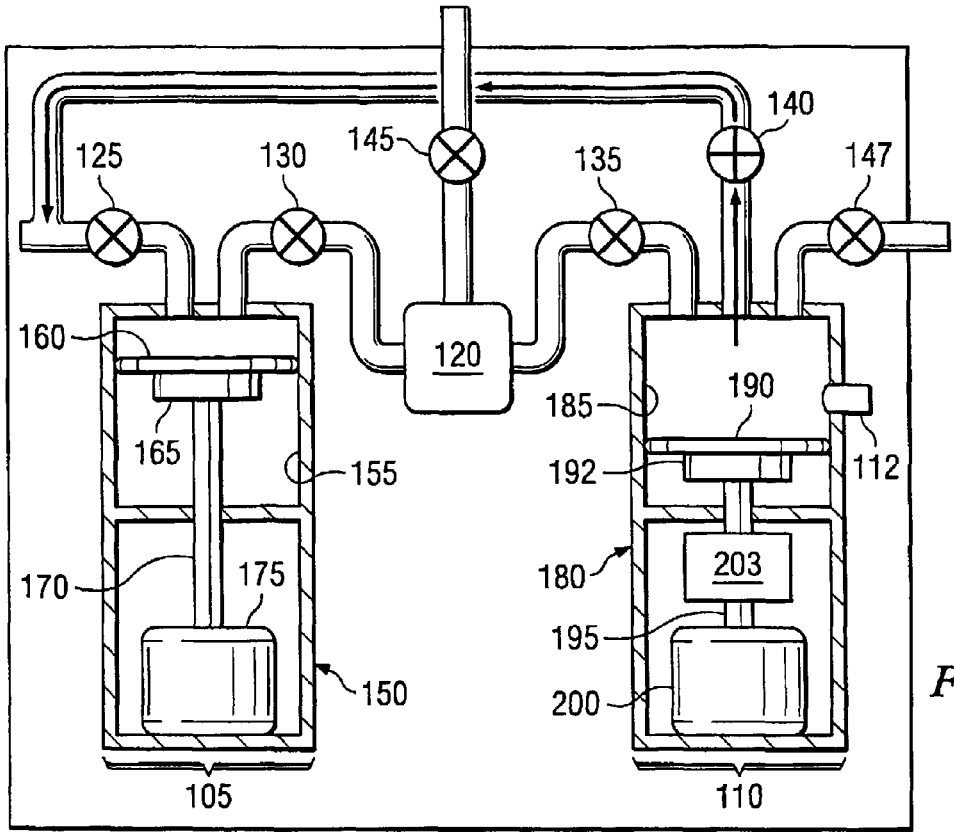

Returning to FIGS. 3A-3G, and using the example of $V_{Dmax}$=5 mL and $V_{FMax}$=4.5 mL, during the ready segment (FIG. 3A), dispense pump 180 will have a volume of 4 mL and feed pump 150 will have a volume of 0 mL. Dispense pump 180, during the dispense segment (FIG. 3B), dispenses 4 mL of fluid and recovers 1 mL during the suckback segment (FIG. 3C). During the feed segment (FIG. 3D), feed pump 150 recharges to 4.5 mL. During the filtration segment (FIG. 3E), feed pump 150 can displace 4 mL of fluid causing dispense pump 180 to fill to 5 mL of fluid. Additionally, during the vent segment, feed pump 150 can vent 0.5 mL of fluid (FIG. 3F). Dispense pump 180, during the purge segment (FIG. 3G) can purge 1 mL of fluid to return to the ready segment. In this example, there is no hold-up volume as all the fluid in the feed segment and dispense segment is moved.

For a pump that is used with several different dispense recipes, the home position, of the dispense pump and feed pump can be selected as the home position that can handle the largest recipe. Table 1, below, provides example recipes for a multi-stage pump.

TABLE 1

| | RECIPE 2 | RECIPE 3 |
|---|---|---|
| Name: | Main Dispense 1 | Main Dispense 2 |
| Dispense Rate | 1.5 mL/sec | 1 mL/sec |
| Dispense Time | 2 sec | 2.5 sec |
| Resulting Volume | 3 mL | 2.5 mL |
| Purge | .5 mL | .5 mL |
| Vent | .25 mL | .25 mL |
| Predispense Rate | 1 mL/sec | .5 mL/sec |
| Predispense Volume | 1 mL | .5 mL |

In the above examples, it is assumed that no fluid is recovered during suckback. It is also assumed that there is a pre-dispense cycle in which a small amount of fluid is dispensed from the dispense chamber. The pre-dispense cycle can be used, for example, to force some fluid through the dispense nozzle to clean the nozzle. According to one embodiment the dispense pump is not recharged between a pre-dispense and a main dispense. In this case:

$$V_D=V_{DPre}+V_{DMain} \quad \text{[EQN. 3]}$$

$V_{DPre}$=amount of pre-dispense dispense
$V_{DMain}$=amount of main dispense

Accordingly, the home position of the dispense diaphragm can be set for a volume of 4.5 mL (3+1+0.5) and the home position of the feed pump can be set to 4.75 mL (3+1+0.5+

0.25). With these home positions, dispense pump 180 and feed pump 150 will have sufficient capacity for Recipe 1 or Recipe 2.

According to another embodiment, the home position of the dispense pump or feed pump can change based on the active recipe or a user-defined position. If a user adjusts a recipe to change the maximum volume required by the pump or the pump adjusts for a new active recipe in a dispense operation, say by changing Recipe 2 to require 4 mL of fluid, the dispense pump (or feed pump) can be adjusted manually or automatically. For example, the dispense pump diaphragm position can move to change the capacity of the dispense pump from 3 mL to 4 mL and the extra 1 mL of fluid can be added to the dispense pump. If the user specifies a lower volume recipe, say changing Recipe 2 to only require 2.5 mL of fluid, the dispense pump can wait until a dispense is executed and refill to the new lower required capacity.

The home position of the feed pump or dispense pump can also be adjusted to compensate for other issues such as to optimize the effective range of a particular pump. The maximum and minimum ranges for a particular pump diaphragm (e.g., a rolling edge diaphragm, a flat diaphragm or other diaphragm known in the art) can become nonlinear with displacement volume or force to drive the diaphragm because the diaphragm can begin to stretch or compress for example. The home position of a pump can be set to a stressed position for a large fluid capacity or to a lower stress position where the larger fluid capacity is not required. To address issues of stress, the home position of the diaphragm can be adjusted to position the diaphragm in an effective range.

Figure 4A:
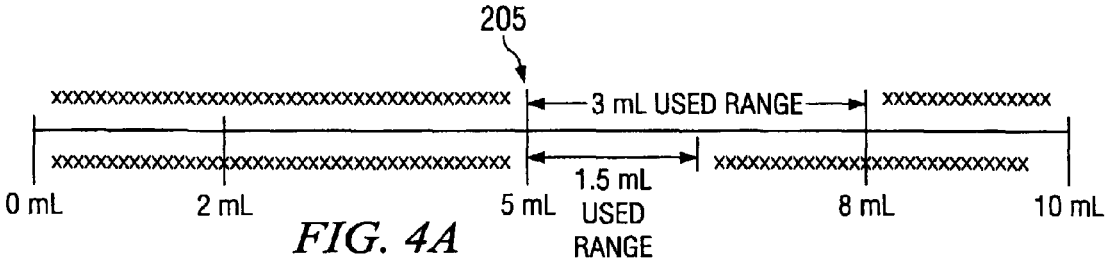
FIGS. 4A-4C are diagrammatic representations of home positions for pumps running various recipes.
Figure 4B:
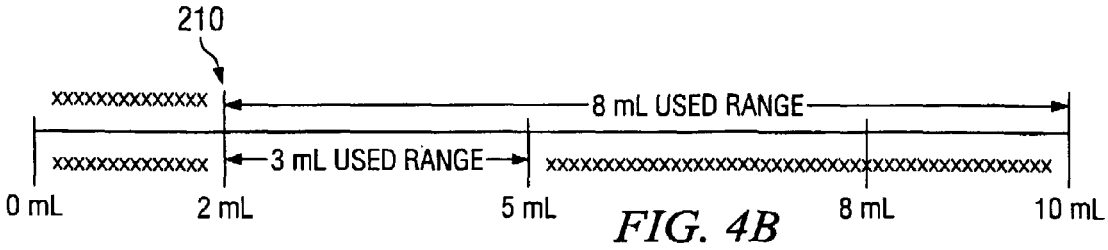
Figure 4C:
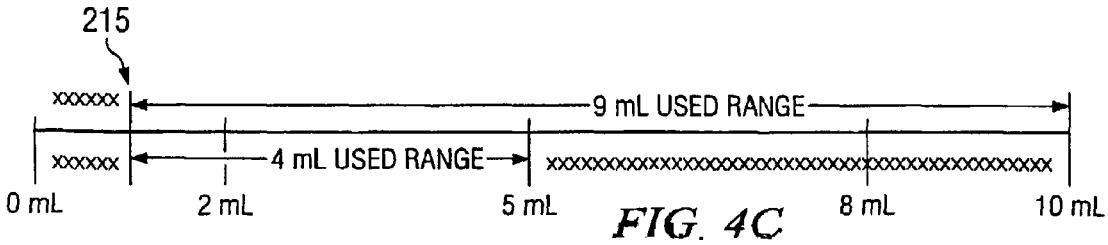

As an example, dispense pump 180 that has a 10 mL capacity may have an effective range between 2 and 8 mL. The effective range can be defined as the linear region of a dispense pump where the diaphragm does not experience significant loading. FIGS. 4A-C provide diagrammatic representations of three examples of setting the home position of a dispense diaphragm (e.g., dispense diaphragm 190 of FIG. 2) for a 10 mL pump having a 6 mL effective range between 2 mL and 8 mL. It should be noted that in these examples, 0 mL indicates a diaphragm position that would cause the dispense pump to have a 10 mL available capacity and a 10 mL position would cause the dispense pump to have a 0 mL capacity. In other words, the 0 mL-10 mL scale refers to the displaced volume.

FIG. 4A provides a diagrammatic representation of the home positions for a pump that runs recipes having a $V_{DMax}$=3 mL maximum volume and a $V_{DMax}$=1.5 mL maximum volume for a pump that has a 6 mL non-stressed effective range (e.g., between 8 ml and 2 ml). In this example, the diaphragm of the dispense pump can be set so that the volume of the dispense pump is 5 mL (represented at 205). This provides sufficient volume for the 3 mL dispense process while not requiring use of 0 mL to 2 mL or 8 mL to 10 mL region that causes stress. In this example, the 2 mL volume of the lower-volume less effective region (i.e., the less effective region in which the pump has a lower available volume) is added to the largest $V_{DMax}$ for the pump such that the home position is 3 mL+2 mL=5 mL. Thus, the home position can account for the non-stressed effective region of the pump.

FIG. 4B provides a diagrammatic representation of a second example. In this second example, the dispense pump runs an 8 mL maximum volume dispense process and a 3 mL maximum volume dispense process. In this case, some of the less effective region must be used. Therefore, the diaphragm home position can be set to provide a maximum allowable volume of 8 ml (represented at 210) for both processes (i.e., can be set at a position to allow for 8 mL of fluid). In this case, the smaller volume dispense process will occur entirely within the effective range.

In the example of FIG. 4B, the home position is selected to utilize the lower-volume less effective region (i.e., the less-effective region that occurs when the pump is closer to empty). In other embodiments, the home position can be in the higher-volume less effective region. However, this will mean that part of the lower volume dispense will occur in the less-effective region and, in the example of FIG. 4B, there will be some hold-up volume.

In the third example of FIG. 4C, the dispense pump runs a 9 mL maximum volume dispense process and a 4 mL maximum volume dispense process. Again, a portion of the process will occur in the less effective range. The dispense diagram, in this example, can be set to a home position to provide a maximum allowable volume of 9 mL (e.g., represented at 215). If, as described above, the same home position is used for each recipe, a portion of the 4 mL dispense process will occur in the less effective range. According to other embodiments, the home position can reset for the smaller dispense process into the effective region.

In the above examples, there is some hold-up volume for the smaller volume dispense processes to prevent use of the less effective region in the pump. The pump can be setup so that the pump only uses the less effective region for larger volume dispense process where flow precision is less critical. These features make it possible to optimize the combination of (i) low volume with higher precision and (ii) high volume with lower precision. The effective range can then be balanced with the desired hold-up volume.

As discussed in conjunction with FIG. 2, dispense pump 180 can include a dispense motor 200 with a position sensor 203 (e.g., a rotary encoder). Position sensor 203 can provide feedback of the position of lead screw 195 and, hence, the position of lead screw 195 will correspond to a particular available volume in dispense chamber 185 as the lead screw displaces diaphragm. Consequently, the pump controller can select a position for the lead screw such that the volume in the dispense chamber is at least $V_{DMax}$.

According to another embodiment, the home position can be user selected or user programmed. For example, using a graphical user interface or other interface, a user can program a user selected volume that is sufficient to carry out the various dispense processes or active dispense process by the multi-stage pump. According to one embodiment, if the user selected volume is less than $V_{Dispense}+V_{Purge}$, an error can be returned. The pump controller (e.g., pump controller 20) can add an error volume to the user specified volume. For example, if the user selects 5 cc as the user specified volume, pump controller 20 can add 1 cc to account for errors. Thus, pump controller will select a home position for dispense pump 180 that has corresponding available volume of 6 cc.

This can be converted into a corresponding lead screw position that can be stored at pump controller 20 or an onboard controller. Using the feedback from position sensor 203, dispense pump 180 can be accurately controlled such that at the end of the filtration cycle, dispense pump 180 is at its home position (i.e., its position having the greatest available volume for the dispense cycle). It should be noted that feed pump 150 can be controlled in a similar manner using a position sensor.

According to another embodiment, dispense pump 180 and/or feed pump 150 can be driven by a stepper motor without a position sensor. Each step or count of a stepper motor will correspond to a particular displacement of the diaphragm. Using the example of FIG. 2, each count of dispense motor 200 will displace dispense diaphragm 190 *a* particular amount and therefore displace a particular amount of fluid from dispense chamber 185. If $C_{fullstrokeD}$ is the counts to displace dispense diaphragm from the position in which dispense chamber 185 has its maximum volume (e.g., 20 mL) to 0 mL (i.e., the number of counts to move dispense diaphragm 190 through its maximum range of motion), $C_P$ is the number of counts to displace $V_P$ and $C_D$ is the number of counts to displace $V_D$, then the home position of stepper motor 200 can be:

$$C_{HomeD}=C_{fullstrokeD}-(C_P+C_D+C_{e1}) \quad \text{[EQN 3]}$$

where $C_{e1}$ is a number of counts corresponding to an error volume.

Similarly, if $C_{fullstrokeF}$ is the counts to displace feed diaphragm 160 from the position in which dispense chamber 155 has its maximum volume (e.g., 20 mL) to 0 mL (i.e., the number of counts to move dispense diaphragm 160 through its maximum range of motion), $C_S$ is the number of counts at the feed motor 175 corresponding to $V_{suckback}$ recovered at dispense pump 180 and $C_V$ is the number of counts at feed motor 175 to displace $V_V$, the home position of feed motor 175 can be:

$$C_{HomeF}=C_{fullstrokeF}-(C_P+C_D-C_S+C_{e2}) \quad \text{[EQN 4]}$$

where $C_{e2}$ is a number of counts corresponding to an error volume.

FIGS. 5A-5K provide diagrammatic representations of various segments for a multi-stage pump 500 according to another embodiment of the present invention. Multi-stage pump 500, according to one embodiment, includes a feed stage pump 501 ("feed pump 501"), a dispense stage pump 502 ("dispense pump 502"), a filter 504, an inlet valve 506 and an outlet valve 508. Inlet valve 506 and outlet valve 508 can be three-way valves. As will be described below, this allows inlet valve 506 to be used both as an inlet valve and isolation valve and outlet valve 508 to be used as an outlet valve and purge valve.

Feed pump 501 and dispense pump 502 can be motor driven pumps (e.g., stepper motors, brushless DC motors or other motor). Shown at 510 and 512, respectively, are the motor positions for the feed pump 501 and dispense pump 502. The motor positions are indicated by the corresponding amount of fluid available in the feed chamber or dispense chamber of the respective pump. In the example of FIGS. 5A-5K, each pump has a maximum available volume of 20 cc. For each segment, the fluid movement is depicted by the arrows.

Figure 5A:
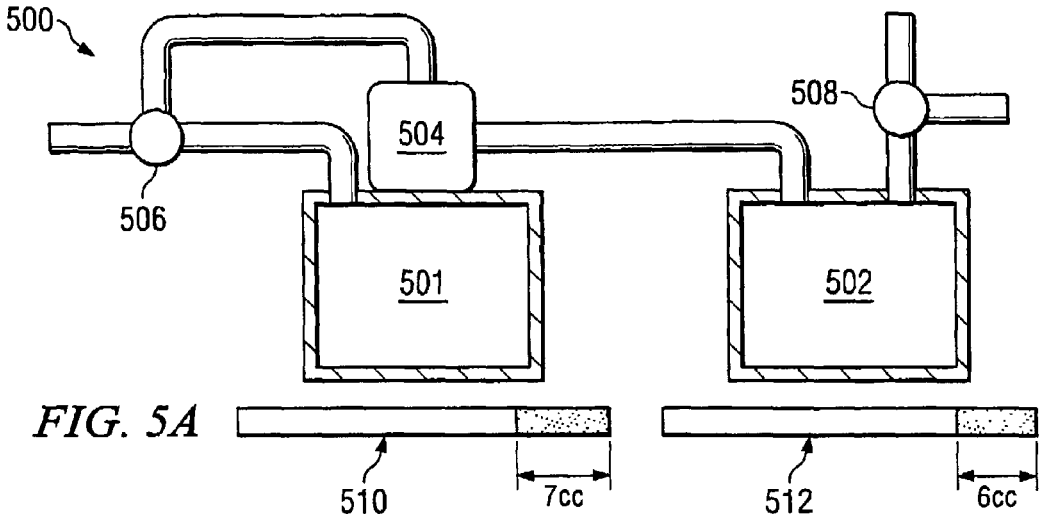
FIG. 5A-5K are diagrammatic representations of another embodiment of a multi-stage pump during various stages of a dispense cycle.
Figure 5B:
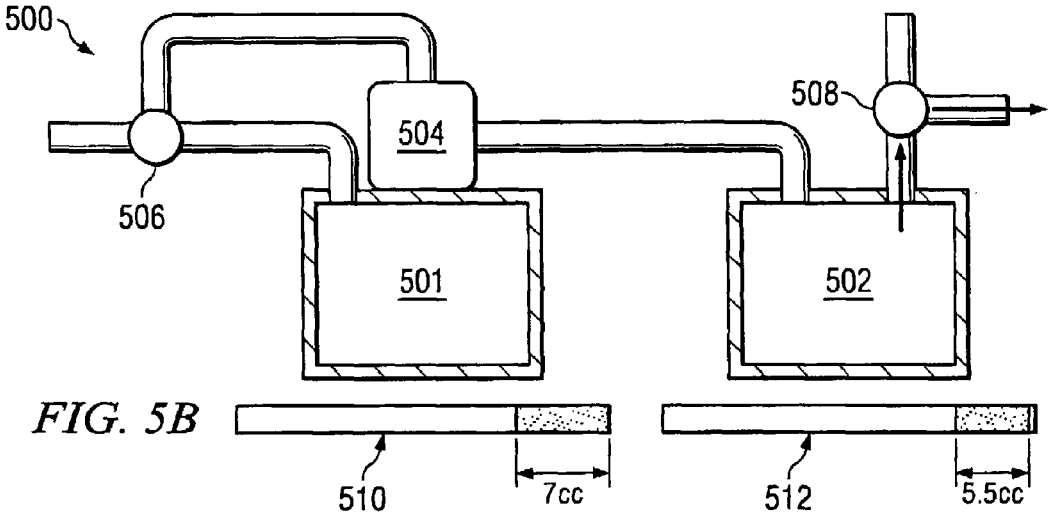
Figure 5C:
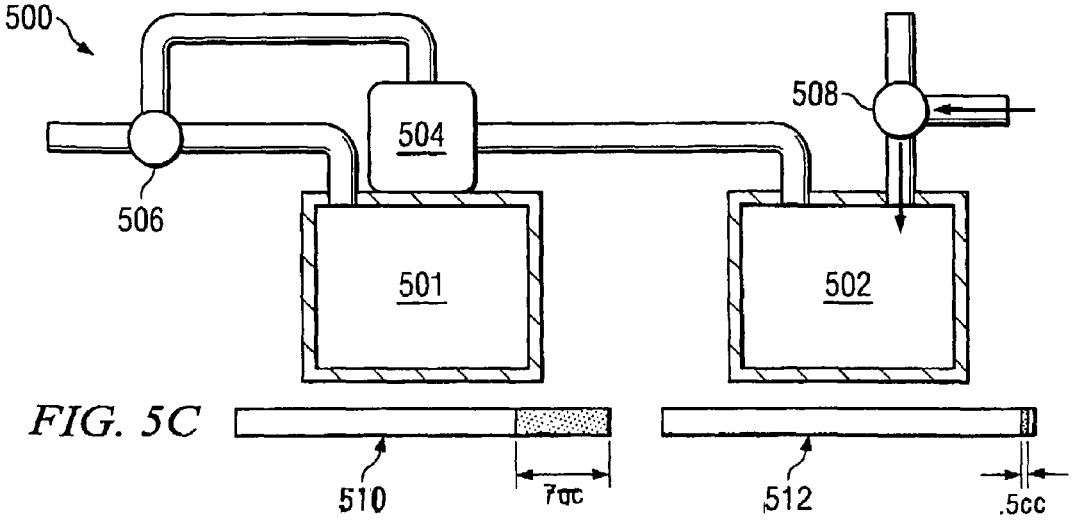
Figure 5D:
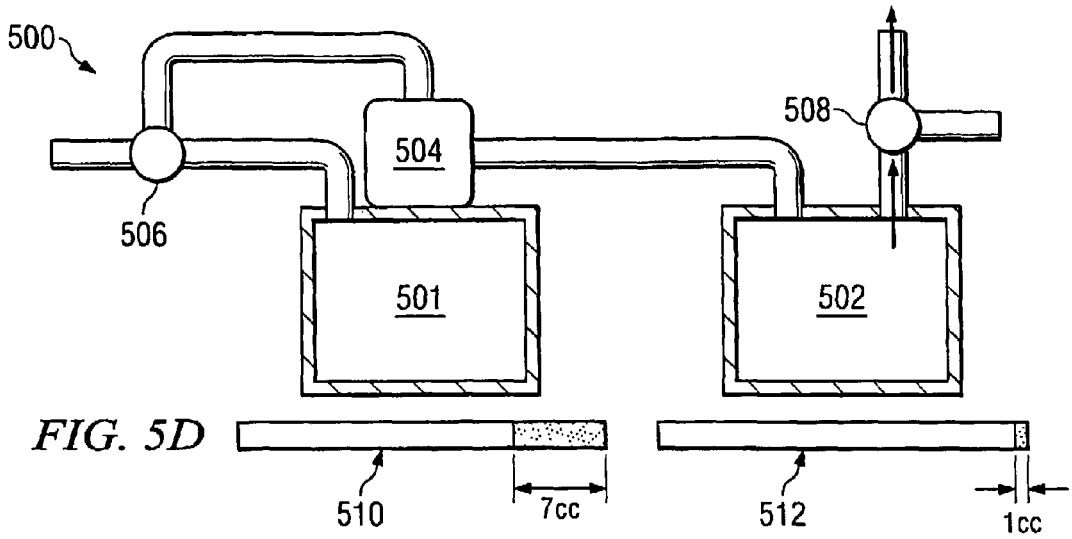
Figure 5E:
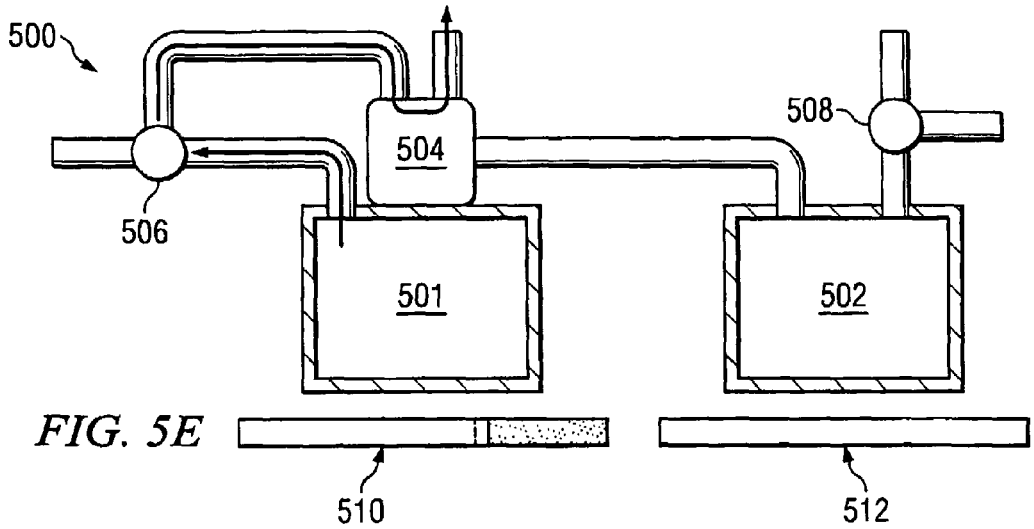
Figure 5F:
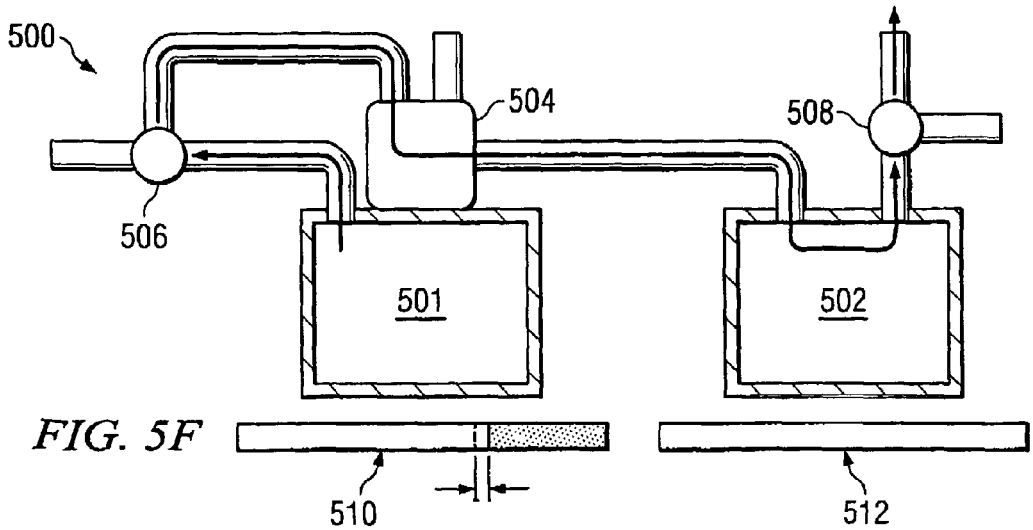
Figure 5G:
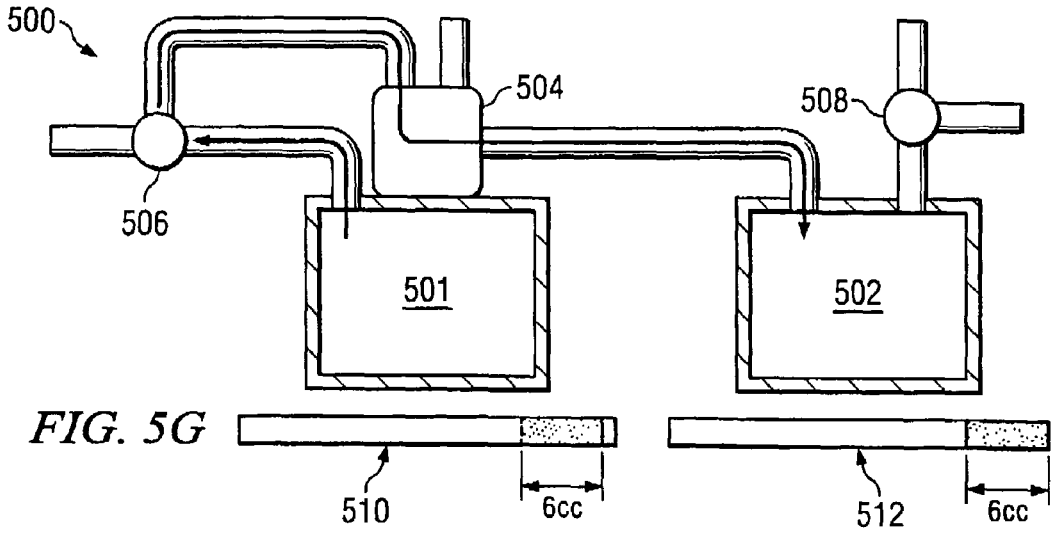

FIG. 5A is a diagrammatic representation of multi-stage pump 500 at the ready segment. In this example, feed pump 501 has a motor position that provides for 7 cc of available volume and dispense pump 502 has a motor position that provides for 6 cc of available volume. During the dispense segment (depicted in FIG. 5B), the motor of dispense pump 502 moves to displace 5.5 cc of fluid through outlet valve 508. The dispense pump recovers 0.5 cc of fluid during the suckback segment (depicted in FIG. 5C). During the purge segment (shown in FIG. 5D), dispense pump 502 displaces 1 cc of fluid through outlet valve 508. During the purge segment, the motor of dispense pump 502 can be driven to a hard stop (i.e., to 0 cc of available volume). This can ensure that the motor is backed the appropriate number of steps in subsequent segments.

In the vent segment (shown in FIG. 5E), feed pump 501 can push a small amount of fluid through filter 502. During the dispense pump delay segment (shown in FIG. 5F), feed pump 501 can begin pushing fluid to dispense pump 502 before dispense pump 502 recharges. This slightly pressurizes fluid to help fill dispense pump 502 and prevents negative pressure in filter 504. Excess fluid can be purged through outlet valve 508.

Figure 5H:
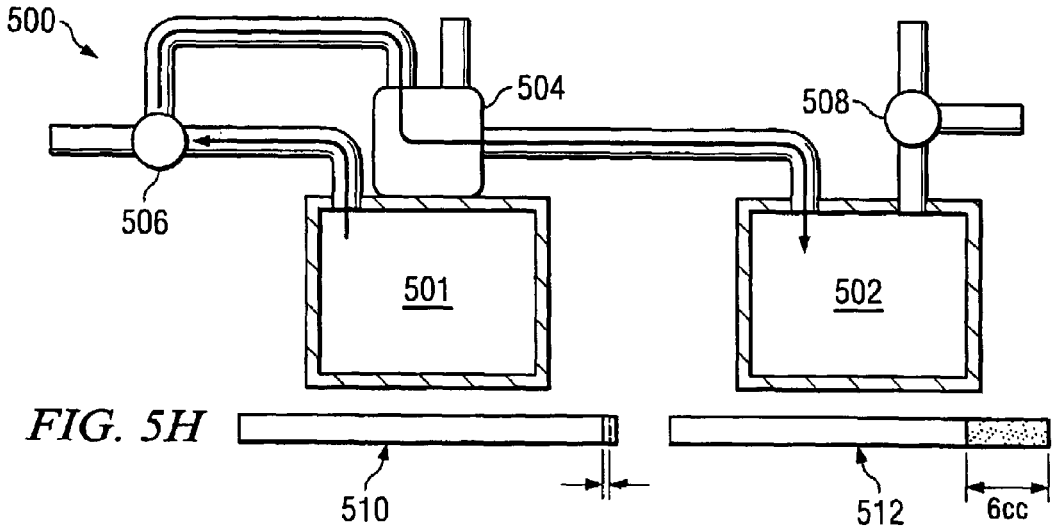
Figure 5I:
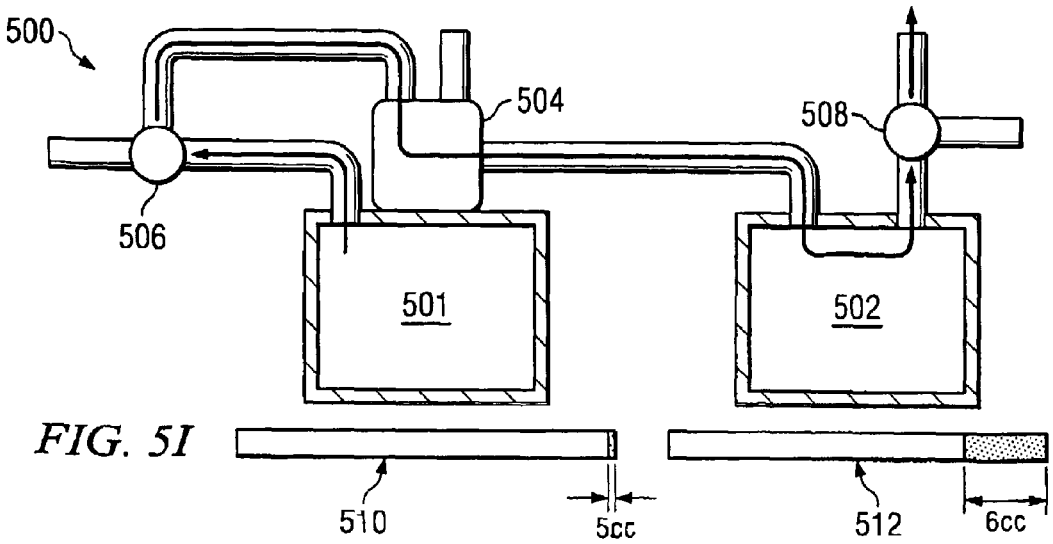
Figure 5J:
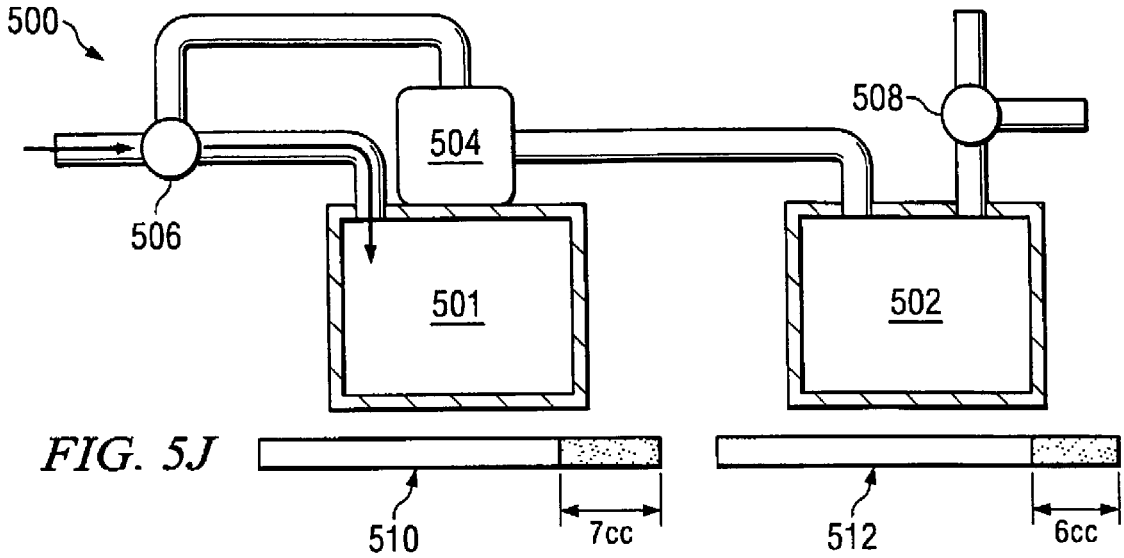
Figure 5K:
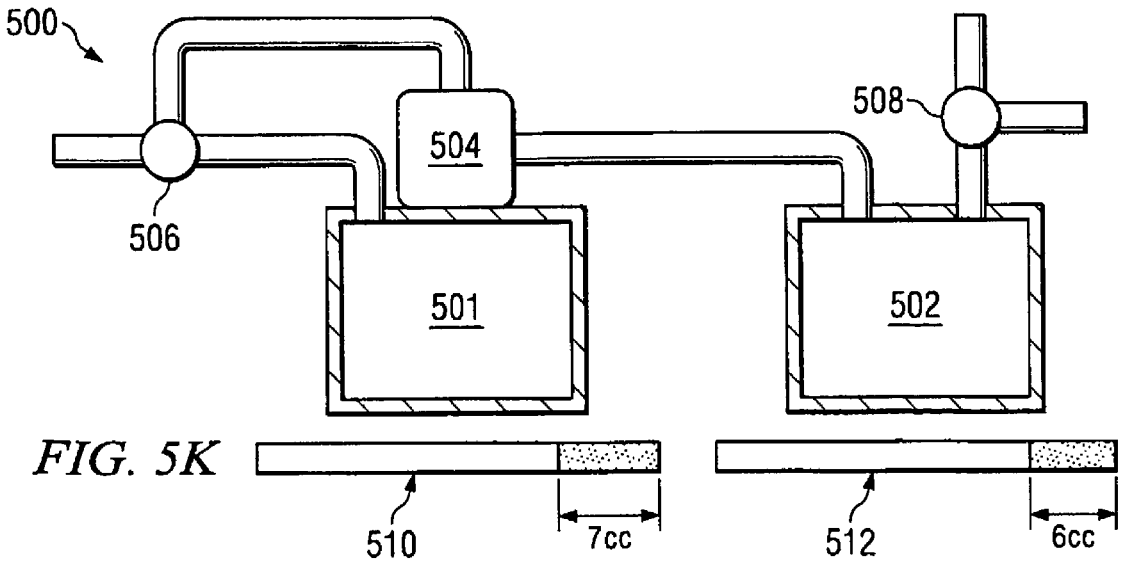

During the filtration segment (shown in FIG. 5G), outlet valve 508 is closed and fluid fills dispense pump 502. In the example shown, 6 cc of fluid is moved by feed pump 501 to dispense pump 502. Feed pump 501 can continue to assert pressure on the fluid after the dispense motor has stopped (e.g., as shown in the feed delay segment of FIG. 5H). In the example of FIG. 5H, there is approximately 0.5 cc of fluid left in feed pump 501. According to one embodiment, feed pump 501 can be driven to a hard stop (e.g., with 0 cc of available volume), as shown in FIG. 5I. During the feed segment (depicted in FIG. 5J), feed pump 501 is recharged with fluid and multi-stage pump 500 returns to the ready segment (shown in FIGS. 5K and 5A).

In the example of FIG. 5A-5K the purge segment occurs immediately after the suckback segment to bring dispense pump 502 to a hardstop, rather than after the vent segment as in the embodiment of FIG. 2. The dispense volume is 5.5 cc, the suckback volume 0.5 cc and purge volume 1 cc. Based on the sequence of segments, the largest volume required by dispense pump 502 is:

$$V_{DMax}=V_{Dispense}+V_{Purge}-V_{suckback}+e_1 \quad \text{[EQN 5]}$$

If dispense pump 502 utilizes a stepper motor, a specific number of counts will result in a displacement of $V_{DMax}$. By backing the motor from a hardstop position (e.g., 0 counts) the number of counts corresponding to $V_{DMax}$, dispense pump will have an available volume of $V_{DMax}$.

For feed pump 501, $V_{vent}$ is 0.5 cc, and there is an additional error volume of 0.5 cc to bring feed pump 501 to a hardstop. According to EQN 2:

$$V_{FMax}=5.5+1+0.5-0.5+0.5$$

In this example, $V_{FMax}$ is 7 cc. If feed pump 501 uses a stepper motor, the stepper motor, during the recharge segment can be backed from the hardstop position the number of counts corresponding to 7 cc. In this example, feed pump 501 utilized 7 cc of a maximum 20 cc and feed pump 502 utilized 6 cc of a maximum 20 cc, thereby saving 27 cc of hold-up volume.

Figure 6:
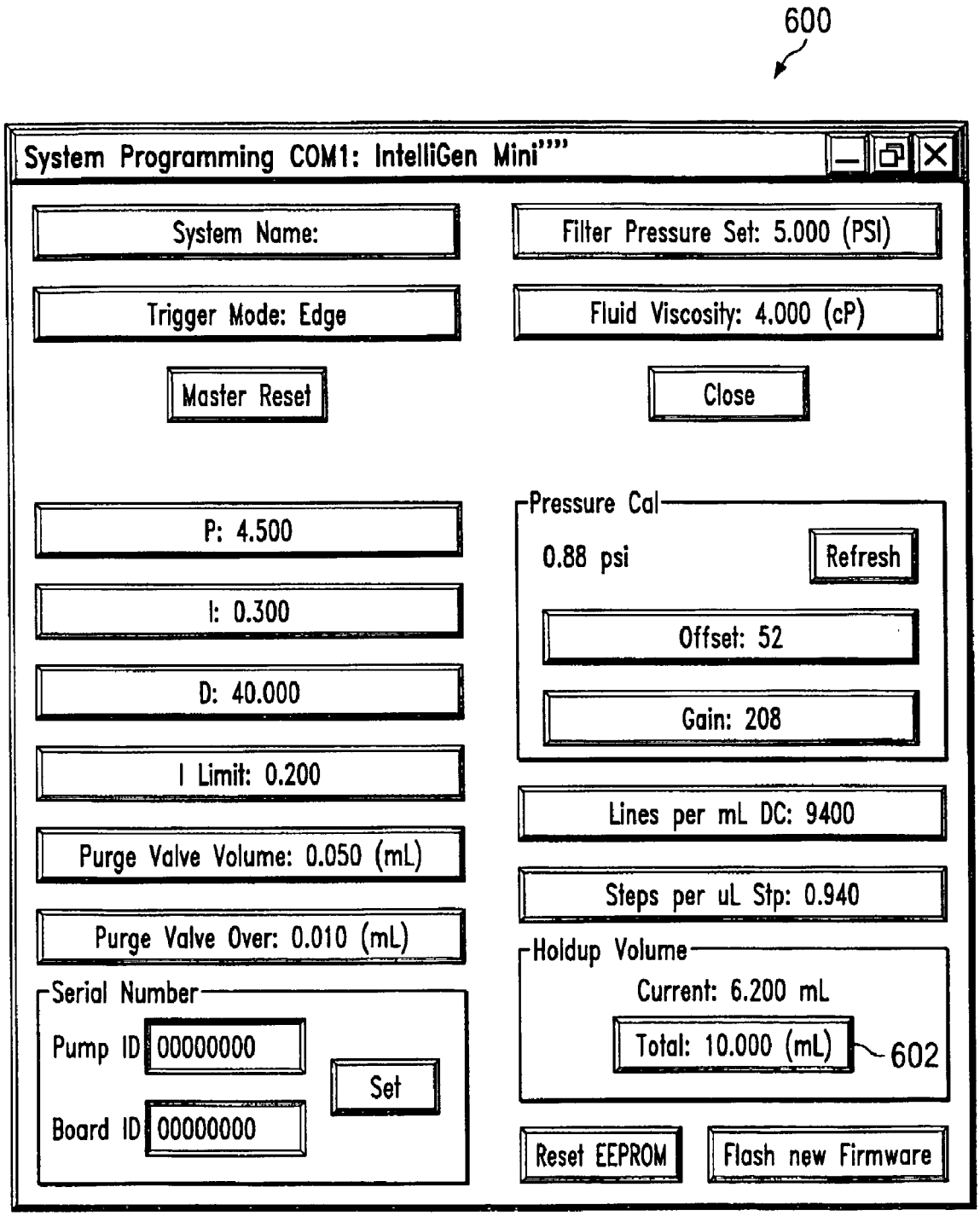
FIG. 6 is a diagrammatic representation of a user interface.

FIG. 6 is a diagrammatic representation illustrating a user interface 600 for entering a user defined volume. In the example of FIG. 6, a user, at field 602, can enter a user defined volume, here 10.000 mL. An error volume can be added to this (e.g., 1 mL), such that the home position of the dispense pump has a corresponding available volume of 11 mL. While FIG. 6 only depicts setting a user selected volume for the dispense pump, the user, in other embodiments, can also select a volume for the feed pump.

Figure 7:
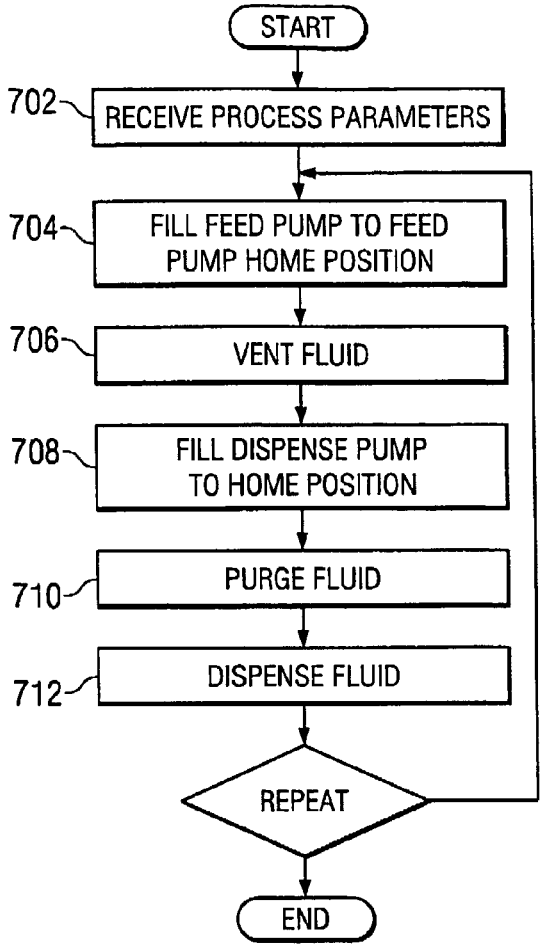
FIG. 7 is a flow chart illustrating one embodiment of a method for reducing hold-up volume at a multi-stage pump.

FIG. 7 is a diagrammatic representation of one embodiment of a method for controlling a pump to reduce the hold-up volume. Embodiments of the present invention can be implemented, for example, as software programming executable by a computer processor to control the feed pump and dispense pump.

At step 702, the user enters one or more parameters for a dispense operation, which may include multiple dispense cycles, including, for example, the dispense volume, purge volume, vent volume, user specified volumes for the dispense pump volume and/or feed pump and other parameters. The parameters can include parameters for various recipes for different dispense cycles. The pump controller (e.g., pump controller 20 of FIG. 1) can determine the home position of the dispense pump based on a user specified volume, dispense volume, purge volume or other parameter associated with the dispense cycle. Additionally, the choice of home position can be based on the effective range of motion of the dispense diaphragm. Similarly, the pump controller can determine the feed pump home position.

During a feed segment, the feed pump can be controlled to fill with a process fluid. According to one embodiment, the feed pump can be filled to its maximum capacity. According to another embodiment, the feed pump can be filled to a feed pump home position (step 704). During the vent segment the feed pump can be further controlled to vent fluid having a vent volume (step 706).

During the filtration segment, the feed pump is controlled to assert pressure on the process fluid to fill the dispense pump until the dispense pump reaches its home position. The dispense diaphragm in the dispense pump is moved until the dispense pump reaches the home position to partially fill the dispense pump (i.e., to fill the dispense pump to an available volume that is less than the maximum available volume of the dispense pump) (step 708). If the dispense pump uses a stepper motor, the dispense diaphragm can first be brought to a hard stop and the stepper motor reversed a number of counts corresponding to the dispense pump home position. If the dispense pump uses a position sensor (e.g., a rotary encoder), the position of the diaphragm can be controlled using feedback from the position sensor.

The dispense pump can then be directed purge a small amount of fluid (step 710). The dispense pump can be further controlled to dispense a predefined amount of fluid (e.g., the dispense volume) (step 712). The dispense pump can be further controlled to suckback a small amount of fluid or fluid can be removed from a dispense nozzle by another pump, vacuum or other suitable mechanism. It should be noted that steps of FIG. 7 can be performed in a different order and repeated as needed or desired.

Figure 8:
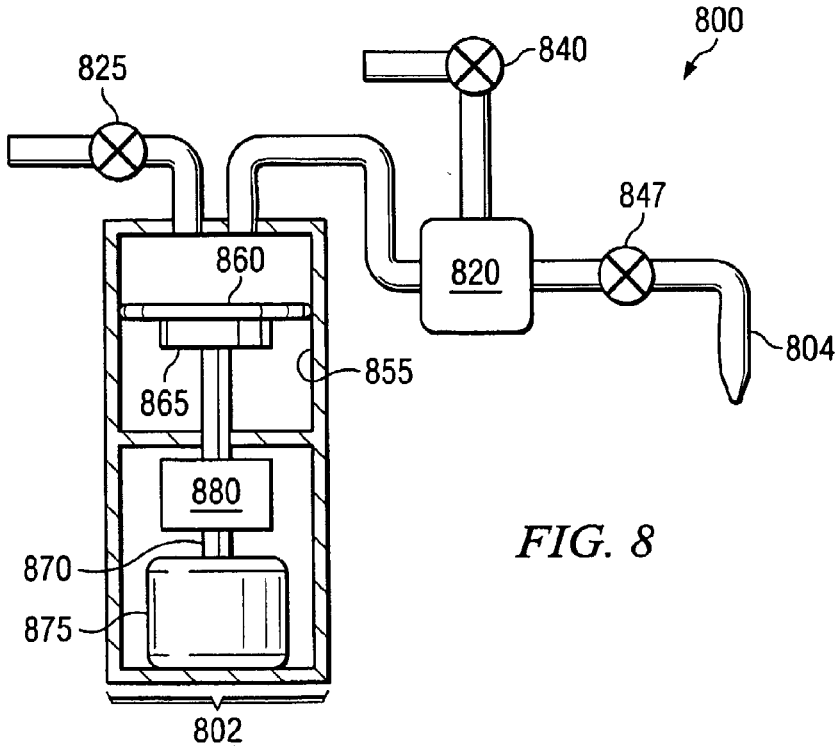
FIG. 8 is a diagrammatic representation of a single stage pump.

While primarily discussed in terms of a multi-stage pump, embodiments of the present invention can also be utilized in single stage pumps. FIG. 8 is a diagrammatic representation of one embodiment of a single stage pump 800. Single stage pump 800 includes a dispense pump 802 and filter 820 between dispense pump 802 and the dispense nozzle 804 to filter impurities from the process fluid. A number of valves can control fluid flow through single stage pump 800 including, for example, purge valve 840 and outlet valve 847.

Dispense pump 802 can include, for example, a dispense chamber 855 to collect fluid, a diaphragm 860 to move within dispense chamber 855 and displace fluid, a piston 865 to move dispense stage diaphragm 860, a lead screw 870 and a dispense motor 875. Lead screw 870 couples to motor 875 through a nut, gear or other mechanism for imparting energy from the motor to lead screw 870. According to one embodiment, feed motor 875 rotates a nut that, in turn, rotates lead screw 870, causing piston 865 to actuate. According to other embodiments, dispense pump 802 can include a variety of other pumps including pneumatically actuated pumps, hydraulic pumps or other pumps.

Dispense motor 875 can be any suitable motor. According to one embodiment, dispense motor 875 is a PMSM with a position sensor 880. The PMSM can be controlled by a DSP FOC at motor 875, a controller onboard pump 800 or a separate pump controller (e.g. as shown in FIG. 1). Position sensor 880 can be an encoder (e.g., a fine line rotary position encoder) for real time feedback of motor 875's position. The use of position sensor 880 gives accurate and repeatable control of the position of dispense pump 802.

The valves of single stage pump 800 are opened or closed to allow or restrict fluid flow to various portions of single stage pump 800. According to one embodiment, these valves can be pneumatically actuated (i.e., gas driven) diaphragm valves that open or close depending on whether pressure or a vacuum is asserted. However, in other embodiments of the present invention, any suitable valve can be used.

In operation, the dispense cycle of single stage pump 100 can include a ready segment, filtration/dispense segment, vent/purge segment and static purge segment. Additional segments can also be included to account for delays in valve openings and closings. In other embodiments the dispense cycle (i.e., the series of segments between when single stage pump 800 is ready to dispense to a wafer to when singe stage pump 800 is again ready to dispense to wafer after a previous dispense) may require more or fewer segments and various segments can be performed in different orders.

During the feed segment, inlet valve 825 is opened and dispense pump 802 moves (e.g., pulls) diaphragm 860 to draw fluid into dispense chamber 855. Once a sufficient amount of fluid has filled dispense chamber 855, inlet valve 825 is closed. During the dispense/filtration segment, pump 802 moves diaphragm 860 to displace fluid from dispense chamber 855. Outlet valve 847 is opened to allow fluid to flow through filter 820 out nozzle 804. Outlet valve 847 can be opened before, after or simultaneous to pump 802 beginning dispense.

At the beginning of the purge/vent segment, purge valve 840 is opened and outlet valve 847 closed. Dispense pump 802 applies pressure to the fluid to move fluid through open purge valve 840. The fluid can be routed out of single stage pump 800 or returned to the fluid supply or dispense pump 802. During the static purge segment, dispense pump 802 is stopped, but purge valve 140 remains open to relieve pressure built up during the purge segment.

An additional suckback segment can be performed in which excess fluid in the dispense nozzle is removed by pulling the fluid back. During the suckback segment, outlet valve 847 can close and a secondary motor or vacuum can be used to suck excess fluid out of the outlet nozzle 804. Alternatively, outlet valve 847 can remain open and dispense motor 875 can be reversed to suck fluid back into the dispense chamber. The suckback segment helps prevent dripping of excess fluid onto the wafer.

It should be noted that other segments of a dispense cycle can also be performed and the single stage pump is not limited to performing the segments described above in the order described above. For example, if dispense motor 875 is a stepper motor, a segment can be added to bring the motor to a hard stop before the feed segment. Moreover, the combined segments (e.g., purge/vent) can be performed as separate segments. According to other embodiments, the pump may not perform the suckback segment. Additionally, the single stage pump can have different configurations. For example, the single stage pump may not include a filter or rather than having a purge valve, can have a check valve for outlet valve 147.

According to one embodiment of the present invention, during the fill segment, dispense pump 802 can be filled to home position such that dispense chamber 855 has sufficient volume to perform each of the segments of the dispense cycle. In the example given above, the available volume corresponding to the home position would be at least the dispense volume plus the purge volume (i.e., the volume released during the purge/vent segment and static purge segment). Any suckback volume recovered into dispense chamber 855 can be subtracted from the dispense volume and purge volume. As with the multi-stage pump, the home position can be determined based on one or more recipes or a user specified volume. The available volume corresponding to the dispense pump home position is less than the maximum available volume of the dispense pump and is the greatest available volume for the dispense pump in a dispense cycle.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed in the following claims.

What is claimed is:

1. A pumping system comprising:

a dispense pump, wherein the dispense pump has a maximum available volume, the dispense pump further comprising:

a dispense diaphragm movable to multiple positions within a dispense chamber, wherein the multiple positions include a dispense pump home position, the dispense pump home position corresponding to an available volume for a process fluid in the dispense pump, and wherein the available volume is less than the maximum available volume;

a dispense motor to move the dispense diaphragm; and a pump controller coupled to the dispense pump, the pump controller operable to:

control the dispense pump to move the dispense diaphragm to a dispense pump hard stop position prior to partially filling the dispense pump, the dispense pump hard stop position corresponding to zero available volume for the process fluid in the dispense pump;

control the dispense pump to move the dispense diaphragm in the dispense chamber from the dispense pump hard stop position to reach the dispense pump home position by reversing the dispense motor a corresponding number of steps such that the dispense pump is partially filled with the process fluid for a dispense operation, wherein the available volume corresponding to home position represents a total available volume for the dispense pump in a dispense cycle and wherein the dispense pump home position is determined by the pump controller based on one or more parameters for the dispense operation; and control the dispense pump to dispense the process fluid from the dispense pump.

2. The system of claim 1, further comprising:

a filter downstream of the dispense pump;

an inlet valve upstream of the dispense pump;

a purge valve downstream of the filter; and an outlet valve downstream of the filter.

3. The system of claim 1, further comprising:

a filter downstream of a feed pump and upstream of the dispense pump;

an inlet valve upstream of the feed pump;

an isolation valve between the feed pump and the filter;

a barrier valve between the filter and the dispense pump;

a purge valve downstream of the dispense pump; and an outlet valve downstream of the dispense pump.

4. The system of claim 1, wherein the pump controller is further operable to control the dispense pump to purge a purge volume of the process fluid and wherein the available volume corresponding to the dispense pump home position is at least a dispense volume plus the purge volume.

5. The system of claim 1, wherein the dispense pump further comprises:

a position sensor to indicate the position of the dispense motor.

6. The system of claim 5, wherein the position sensor is a linear encoder.

7. The system of claim 5, wherein the position sensor is a rotary encoder.

8. The system of claim 5, wherein the pump controller is further operable to control the dispense motor to move the dispense diaphragm from a first position to the dispense pump home position.

9. The system of claim 8, wherein the pump controller is further operable to stop the dispense diaphragm at the dispense pump home position based on feedback from the position sensor.

10. The system of claim 1, further comprising:

a feed pump comprising a feed diaphragm movable within a feed chamber; and wherein the pump controller is connected to the feed pump and operable to control the feed pump to assert a pressure on the process fluid to provide the process fluid to the dispense pump.

11. The system of claim 10, wherein the pump controller is further operable to control the feed pump to move the feed diaphragm to a feed pump home position such that the feed pump is partially filled.

12. The system of claim 11, wherein the pump controller is further operable to control the feed pump to vent a vent volume of the process fluid.

13. The system of claim 12, wherein an available volume of the feed pump when the feed diaphragm is at the feed pump home position is at least equal to a dispense volume, the vent volume and a purge volume.

14. The system of claim 1, wherein the available volume of the dispense pump corresponding to the dispense pump home position is at least equal to a user-specified volume.

15. The system of claim 14, wherein the controller is further operable to:

receive an instruction for the user-specified volume; and add an error volume to the user-specified volume to determine the available volume of the dispense pump corresponding to the dispense pump home position.

16. The system of claim 1, further comprising:

a feed pump comprising a feed diaphragm movable within a feed chamber; and wherein the pump controller is connected to the feed pump and operable to:

control the feed pump to assert a pressure on the process fluid to provide the process fluid to the dispense pump;

receive an instruction for a user-specified volume for the feed pump;

add an error volume to the user specified volume to determine the available volume of the feed pump corresponding to the feed pump home position.

17. The system of claim 1, wherein the dispense pump home position is determined by the pump controller to utilize a low stress region of the dispense diaphragm.

18. A method for reducing hold-up volume of a process fluid in a pump system comprising:

providing a process fluid to a dispense pump, wherein the dispense pump has a maximum available volume, the dispense pump further comprising a dispense diaphragm movable to multiple positions within a dispense chamber, wherein the multiple positions include a dispense pump home position, wherein the dispense pump home position corresponds to an available volume of the process fluid in the dispense pump, and wherein the available volume is less than the maximum available volume;

selecting a dispense pump home position for the dispense pump based on one or more parameters for a dispense operation;

moving the dispense diaphragm to a dispense pump hard stop position, the dispense pump hard stop position corresponding to zero available volume for the process fluid in the dispense pump;

moving the dispense diaphragm in the dispense chamber from the dispense pump hard stop position to reach the dispense pump home position by reversing the dispense motor a corresponding number of steps, such that the dispense pump is partially filled with the process fluid for a dispense cycle, wherein the available volume corresponding to the dispense pump home position represents a total available volume at the dispense pump for the dispense cycle; and dispensing the process fluid from the dispense pump to a wafer, wherein a dispense volume of the process fluid is dispensed from the dispense pump with at least a portion of the dispense volume of the process fluid being dispensed to the wafer, and wherein the available volume corresponding to the dispense pump home position of the dispense pump is at least the dispense volume of the process fluid.

19. The method of claim 18, further comprising purging a purge volume of the process fluid from the dispense pump before or after the step of dispensing the process fluid from the dispense pump to the wafer.

20. The method of claim 19, wherein the available volume of the dispense pump corresponding to the dispense pump home position is at least the dispense volume plus the purge Volume.

21. The method of claim 20, wherein purging occurs in the dispense cycle prior to dispensing.

22. The method of claim 18, wherein purging occurs in the dispense cycle subsequent to dispensing.

23. The method of claim 18, further comprising:

partially filling a feed pump to a feed pump home position, wherein the feed pump has an available volume corresponding to the feed pump home position that is less than the maximum available volume of the feed pump and the total available volume for the feed pump during the dispense cycle and wherein the available volume corresponding to the feed pump home position is at least the dispense volume.

24. The method of claim 23, further comprising venting a vent volume of process fluid, wherein the available volume corresponding to the feed pump home position is at least the vent volume plus the dispense volume.

25. The method of claim 24, further comprising purging a purge volume of process fluid from the dispense pump before or after the step of dispensing the process fluid from the dispense pump to the wafer, wherein the available volume corresponding to the feed pump home position is at least the vent volume plus the dispense volume plus the purge volume.

26. The method of claim 25, further comprising sucking back a suckback volume of process fluid at the dispense pump, wherein the available volume at the feed pump corresponding to the feed pump home position is at least the vent volume plus the dispense volume plus the purge volume minus the suckback volume.

27. The method of claim 18, further comprising selecting the dispense pump home position based on an effective range of the dispense diaphragm.

28. A computer program product comprising a set of computer instructions stored a computer readable medium, the computer instructions comprising instructions executable by a processor to:

receive one or more parameters for a dispense operation;

select a dispense pump home position for a dispense pump based on the one or more parameters;

direct the dispense pump to move a dispense diaphragm to a dispense pump hard stop position prior to partially filling the dispense pump, the dispense pump hard stop position corresponding to zero available volume for the process fluid in the dispense pump;

direct the dispense pump to move the dispense diaphragm from the dispense pump hard stop position to reach the dispense pump home position by reversing a dispense motor a corresponding number of steps to partially fill the dispense pump with a process fluid, wherein an available volume corresponding to the dispense pump home position is less than the maximum available volume of the dispense pump and represents a total available volume for the dispense pump in a dispense cycle; and direct the dispense pump to dispense the process fluid from the dispense pump.

29. The computer program product of claim 28, wherein the set of computer instructions further comprise instructions executable to direct the dispense pump to purge a purge volume of the process fluid, wherein the available volume of the dispense pump corresponding to the dispense pump home position is at least a dispense volume plus the purge volume.

30. The computer program product of claim 28, wherein the set of computer instructions further comprise instructions executable to control the dispense motor to move the dispense diaphragm from a first position to the dispense pump home position.

31. The computer program product of claim 30, wherein the set of computer instructions further comprise instructions executable to:

receive feedback from a position sensor at the dispense pump; and stop the dispense diaphragm at the dispense pump home position based on the feedback from the position sensor.

32. The computer program product of claim 28, wherein the set of computer instructions further comprise instructions executable to:

direct a feed pump to assert pressure on the process fluid to provide the process fluid to the dispense pump; and direct the feed pump to move a feed diaphragm to a feed pump home position to partially fill the feed pump.

33. The computer program product of claim 32, wherein the set of computer instructions further comprise instructions executable to direct the feed pump to vent a vent volume of the process fluid.

34. The computer program product of claim 33, wherein an available volume of the feed pump when the feed diaphragm is at the feed pump home position is at least equal to the dispense volume plus the vent volume plus a purge volume.

35. The computer program product of claim 28, wherein the available volume of the dispense pump when the dispense diaphragm is at the dispense pump home position is at least equal to a user-specified dispense pump volume.

36. The computer program product of claim 35, wherein the one or more parameters for the dispense operation include the user-specified dispense pump volume and wherein the set of computer instructions further comprise instructions executable to:

add an error volume to the user-specified dispense pump volume to determine the available volume corresponding to the dispense pump home position.

37. The computer program product of claim 28, wherein an available volume of the feed pump when the feed pump is at the feed pump home position is at least equal to a user-specified feed pump volume.

38. The computer program product of claim 37, wherein the one or more parameters for the dispense operation include the user-specified feed pump volume and wherein the set of computer instructions further comprise instructions executable to:

add an error volume to the user-specified feed pump volume to determine the available volume corresponding to the dispense pump home position.

39. The computer program product of claim 28, wherein the set of computer instructions further comprise instructions executable to select the dispense pump home position to utilize an effective range of the dispense diaphragm.

* * * * *